US007054586B2

(12) United States Patent
Kuroda

(10) Patent No.: US 7,054,586 B2
(45) Date of Patent: May 30, 2006

(54) TRANSFER APPARATUS, IMAGE FORMING APPARATUS, AND METHOD OF CORRECTING MOVING SPEED OF BELT

(75) Inventor: Hiroyuki Kuroda, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 179 days.

(21) Appl. No.: 10/743,807

(22) Filed: Dec. 24, 2003

(65) Prior Publication Data

US 2004/0197111 A1 Oct. 7, 2004

(30) Foreign Application Priority Data

Dec. 26, 2002 (JP) ..... 2002-378033
Dec. 19, 2003 (JP) ..... 2003-423764

(51) Int. Cl.
*G03G 15/16* (2006.01)

(52) U.S. Cl. ..... 399/302; 399/303

(58) Field of Classification Search ..... 399/162, 399/167, 302, 303
See application file for complete search history.

(56) References Cited

U.S. PATENT DOCUMENTS 6,336,019 B1 * 1/2002 Castelli et al. ..... 399/162
6,842,602 B1 * 1/2005 Kudo ..... 399/303
6,925,279 B1 * 8/2005 Kamoshita et al. ..... 399/303
6,947,693 B1 * 9/2005 Kamiya et al. ..... 399/302
2003/0053818 A1 3/2003 Kimura

FOREIGN PATENT DOCUMENTS

JP 11-24507 1/1999

OTHER PUBLICATIONS

U.S. Appl. No. 10/743,807, filed Dec. 24, 2003, Kuroda
U.S. Appl. No. 10/927,344, filed Aug. 27, 2004, Takayama et al.
U.S. Appl. No. 10/244,706, filed Sep. 17, 2002, Kimura
U.S. Appl. No. 11/169,676, filed Dec. 24, 2003, Iwasaki

* cited by examiner

*Primary Examiner*—William J. Royer
(74) *Attorney, Agent, or Firm*—Oblon, Spivak, McClelland, Maier & Neustadt, P.C.

(57) ABSTRACT

A scale is provided along at least one side of a portion of a belt. A sensor reads the scale on the belt to obtain scale information. An actual speed calculating unit calculates a speed of the belt from the scale information. A speed calculating unit calculates a speed of the belt from information other than the scale information. A control unit that provides a control to correct speed of the belt according to the speed calculated by the actual speed calculating unit when the speed calculated by the actual speed calculating unit is normal, and provides a control to correct speed of the belt according to the speed calculated by the speed calculating unit when the speed calculated by the actual speed calculating unit is abnormal.

42 Claims, 23 Drawing Sheets

TRANSFER APPARATUS, IMAGE FORMING APPARATUS, AND METHOD OF CORRECTING MOVING SPEED OF BELT

CROSS-REFERENCE TO RELATED APPLICATIONS

The present document incorporates by reference the entire contents of Japanese priority document, 2002-378033 filed in Japan on Dec. 26, 2002, and 2003-423764 filed in Japan on Dec. 19, 2003.

BACKGROUND OF THE INVENTION

1) Field of the Invention

The present invention relates to a transfer apparatus that reads a scale, provided along the whole circumference of a belt that is made to rotate, by a sensor, and detects an actual speed of the belt based on information from the scale to correct a speed of the belt to a target speed according to the detected actual speed, and an image forming apparatus and a method of correcting the moving speed of the belt.

2) Description of the Related Art

Copying machines and printers as an image forming apparatus using an electrophotographic system have, in many cases, a function of forming a full color image according to increasing demands of the market.

The image forming apparatus capable of forming a color image includes a one drum type and a tandem type.

The one drum type of image forming apparatus includes a plurality of developing devices, which develop images with toners of colors, provided around one photosensitive element. The toners are deposited to latent images formed on the photosensitive element to form a full color composite toner image, and the toner image is transferred to a sheet as a recording material to obtain a color image.

The tandem type of image forming apparatus includes a plurality of photosensitive elements arranged in tandem and a plurality of developing devices that develop images with toners of different colors corresponding to the photosensitive elements. Single-color toner images are formed on the respective photosensitive elements, and the single-color toner images are successively transferred to a belt or a sheet to form a full color composite toner image.

The one drum type of image forming apparatus has one photosensitive element, and therefore, the whole of the image forming apparatus can be comparatively downsized, and the cost can be reduced accordingly. However, the one photosensitive element is made to rotate a plurality of times (four times for a full color image) to form a full color image on a sheet, which makes it difficult to increase the speed of image formation.

In the tandem type of image forming apparatus, the image forming apparatus requires a plurality of photosensitive elements, and therefore, the image forming apparatus tends to be upsized, and the cost is increased accordingly. However, the speed of the image formation can be increased.

As there is a desire to have image formation speed in the full color image formation as that in the monochrome-level image formation, much attention is now focused on the tandem type of image forming apparatus.

The tandem type of image forming apparatus employs a direct transfer system as shown in FIG. 22 or an indirect transfer system as shown in FIG. 24.

In the image forming apparatus of the direct transfer system, toner images formed on photosensitive elements 91Y, 91M, 91C, and 91K aligned in a row are sequentially transferred, by transfer devices 92, to a sheet of paper P carried on a sheet conveying belt 93 that rotates in the direction of arrow A, and a full color image is formed on the sheet P.

In the image forming apparatus of the indirect transfer system as shown in FIG. 24, toner images formed on the photosensitive elements 91Y, 91M, 91C, and 91K are sequentially transferred superposedly to an intermediate transfer belt 94 that rotates in the direction of arrow B, and the toner images on the intermediate transfer belt 94 are collectively transferred to the sheet of paper P, by a secondary transfer device 95.

When these two transfer systems are compared, it is obvious that the former has a disadvantage such that the whole configuration of the image forming apparatus is elongated in a direction of the sheet conveyance because a paper feed device 96 is provided on the upstream side of a plurality of photosensitive elements 91Y, 91M, 91C, and 91K and a fixing device 97 is provided on the downstream side thereof.

On the other hand, the latter has an advantage such that the image forming apparatus is downsized in its lateral direction (horizontal direction in FIG. 24), because as a secondary transfer position can be comparatively freely set, the secondary transfer device 95 and the paper feed device 96 can be provided under the intermediate transfer belt 94 as shown in FIG. 24.

Furthermore, in the former, if the image forming apparatus is tried to be made smaller in the lateral direction, the fixing device 97 has to be provided close to the sheet conveying belt 93. However, the front edge of the sheet P reaching a nip of the fixing device 97 is necessary to be warped so as to accommodate a difference in speed between the sheet conveying belt 93 and the fixing device 97 (the fixing device 97 moves slower). If the fixing device 97 is provided in the above manner, the distance from the sheet conveying belt 93 to the fixing device 97 is very short, and therefore, the shock, produced when the front edge of a thick sheet in particular reaches the fixing device 97, causes vibrations to occur over the sheet, and this easily affects an image.

On the other hand, in the latter, the secondary transfer device 95 can be provided under the intermediate transfer belt 94. Therefore, even if it is made smaller in the lateral direction, the image forming apparatus still has a space to dispose the fixing device 97 apart from the intermediate transfer belt 94. Consequently, even if the front edge of the sheet P reaches the nip of the fixing device 97, the sheet P can be warped to accommodate the difference, and therefore, the image is prevented from being badly affected thereby.

As explained above, the indirect transfer system of tandem type image forming apparatus is drawing attention because of its advantages.

In the tandem type of image forming apparatus, toner images of different colors formed on the photosensitive elements are superposed on the sheet or the intermediate transfer belt to form a color image. Therefore, if a position on which the images are superposed is deviated from a target position, color misalignment or a slight change in hue may occur in an image. Thus, image quality is degraded. Accordingly, the positional deviation (color misalignment) of the color toner images is a significant matter.

One of the causes of color misalignment is speed variations of the intermediate transfer belt in the case of the transfer apparatus of the indirect transfer system (sheet conveying belt in the case of the direct transfer system).

Japanese Patent Application Laid Open, (JP-A) No. H11-24507 (pages 3 to 4, FIG. 1) discloses a technology to correct speed variations of a transfer belt.

In this technology, a color copying machine is described such that an intermediate transfer belt (transfer belt) is rotatably supported among five support rollers including one drive roller, and toner images of four colors of cyan, magenta, yellow, and black are sequentially transferred superposedly to the circumferential surface of the transfer belt to form a full color image.

Provided on the internal surface of the transfer belt is a scale with scale marks finely and accurately formed thereon. The scale is read by an optical detector to accurately detect the moving speed of the transfer belt. The detected moving speed is feedback-controlled by a feedback control system so that the speed of the transfer belt becomes an accurately controlled moving speed.

However, even in the color copying machine described in JP-A No. H11-24507, toner fly-off inside the color copying machine may be deposited on the scale with time. Even if the scale has the finely and accurately formed scale marks, a sensor cannot detect such a toner-deposited scale, which causes the speed of the transfer belt to be deviated from a target speed. Thus, the color misalignment or the change in hue may occur in the color image.

SUMMARY OF THE INVENTION

It is an object of the present invention to solve at least the problems in the conventional technology.

A transfer apparatus according to one aspect of the present invention includes a belt that rotates and carries either one of a plurality of images directly and a recording material with a plurality of images, a scale is provided along at least one side of a portion of the belt; a sensor that reads the scale on the belt to obtain scale information; and an actual speed calculating unit that calculates a speed of the belt from the scale information; a speed calculating unit that calculates a speed of the belt from information other than the scale information; and a control unit that provides a control to correct speed of the belt according to the speed calculated.

A transfer apparatus according to another aspect of the present invention includes a belt that rotates by the torque of a motor as a stepping motor and carries either one of a plurality of images directly and a recording material with a plurality of images, a scale is provided along at least one side of the entire circumference of an interior surface of the belt; a sensor that reads the scale on the belt to obtain scale information; an actual speed calculating unit that calculates a speed of the belt from the scale information; an abnormality detection unit that decides whether the speed of the belt detected by the actual speed calculating unit is abnormal; a control unit that provides a control to correct speed of the belt according to the speed calculated; and a motor control unit that, when the abnormality detection unit decides that the speed of the belt detected by the actual speed calculating unit is abnormal, invalidates correction of the speed of the belt by the control unit and controls the stepping motor to rotate at a predetermined target speed.

An image forming apparatus according to still another aspect of the present invention includes a transfer apparatus that includes a belt that rotates and carries either one of a plurality of images directly and a recording material with a plurality of images, a scale is provided along at least one side of a portion of the belt; a sensor that reads the scale on the belt to obtain scale information; an actual speed calculating unit that calculates a speed of the belt from the scale information; a speed calculating unit that calculates a speed of the belt from information other than the scale information; and a control unit that provides a control to correct speed of the belt according to the speed calculated.

An image forming apparatus according to still another aspect of the present invention includes a transfer apparatus that includes a belt that rotates by torque of a motor as a stepping motor and carries either one of a plurality of images directly and a recording material with a plurality of images, a scale is provided along at least one side of the entire circumference of an internal surface of the of the belt; a sensor that reads the scale on the belt to obtain scale information; an actual speed calculating unit that calculates a speed of the belt from the scale information; an abnormality detection unit that decides whether the speed of the belt detected by the actual speed calculating unit is abnormal; a control unit that provides a control to correct speed of the belt according to the speed calculated; and a motor control unit that, when the abnormality detection unit decides that the speed of the belt detected by the actual speed calculating unit is abnormal, invalidates correction of the speed of the belt by the control unit and controls the stepping motor to rotate at a predetermined target speed.

A method of correcting a speed of a belt according to still another aspect of the present invention includes reading a scale on the belt to obtain scale information, the belt being rotatable and which carries either one of a plurality of images directly and a recording material with a plurality of images, a scale is provided along at least one side of a portion of the belt; calculating a speed of the belt from the scale information; calculating a speed of the belt from information other than the scale information; controlling the speed of the belt according to the speed calculated.

A method of correcting a speed of a belt according to still another aspect of the present invention includes reading a scale on the belt to obtain scale information, the belt being rotated by a stepping motor and carries either one of a plurality of images directly and a recording material with a plurality of images, a scale is provided along at least one side of the entire circumference of an internal surface of the belt; calculating a speed of the belt from the scale information; deciding whether the speed of the belt calculated from the scale information is abnormal; and controlling the speed of the belt based on the speed of the belt calculated from the scale information when it is decided at the deciding step that the speed of the belt calculated from the scale information is normal, and controlling speed of rotation of the stepping motor so as to be substantially the same as a predetermined target speed when it is decided at the deciding step that the speed of the belt calculated from the scale information is abnormal.

A method of correcting a speed of a belt according to still another aspect of the present invention includes reading a scale on the belt to obtain scale information, the belt being rotated by a stepping motor and carries either one of a plurality of images directly and a recording material with a plurality of images, a scale is provided along at least one side of entire circumference of an internal surface of the belt; calculating a speed of the belt from the scale information; calculating a speed of the belt from information other than the scale information; deciding whether the speed of the belt calculated from the scale information and the speed of the belt calculated from the information other than the scale information are abnormal; and controlling the speed of the belt based on the speed of the belt calculated from the scale information when it is decided at the deciding step that the speed of the belt calculated from the scale information is normal, controlling the speed of the belt based on the speed of the belt calculated from the information other than the scale information when it is decided at the deciding step that the speed of the belt calculated from the scale information is abnormal, and controlling the speed of the stepping motor so as to be substantially same as a predetermined target speed when it is decided step at the deciding that the speed of the belt calculated from the scale information and the speed of the belt calculated from the information other than the scale information are abnormal.

The other objects, features, and advantages of the present invention are specifically set forth in or will become apparent from the following detailed descriptions of the invention when read in conjunction with the accompanying drawings.

DETAILED DESCRIPTION OF THE PREFERRED EMBODIMENTS

Exemplary embodiments of the present invention are explained in detail below with reference to the accompanying drawings.

Figure 1:
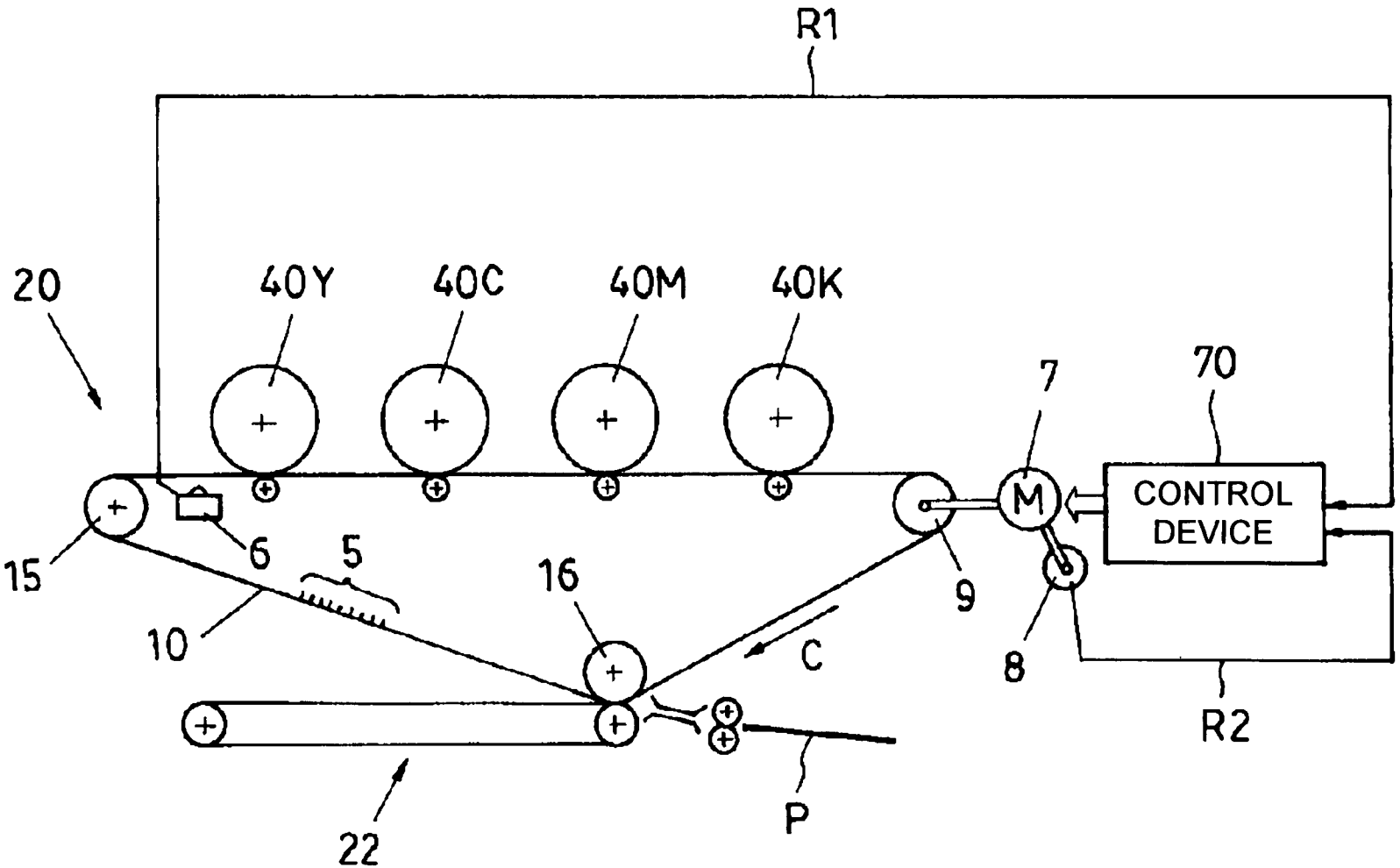
FIG. 1 is a diagram of a transfer apparatus, together with a control system and a plurality of photosensitive elements, according to a first embodiment of the present invention.
Figure 2:
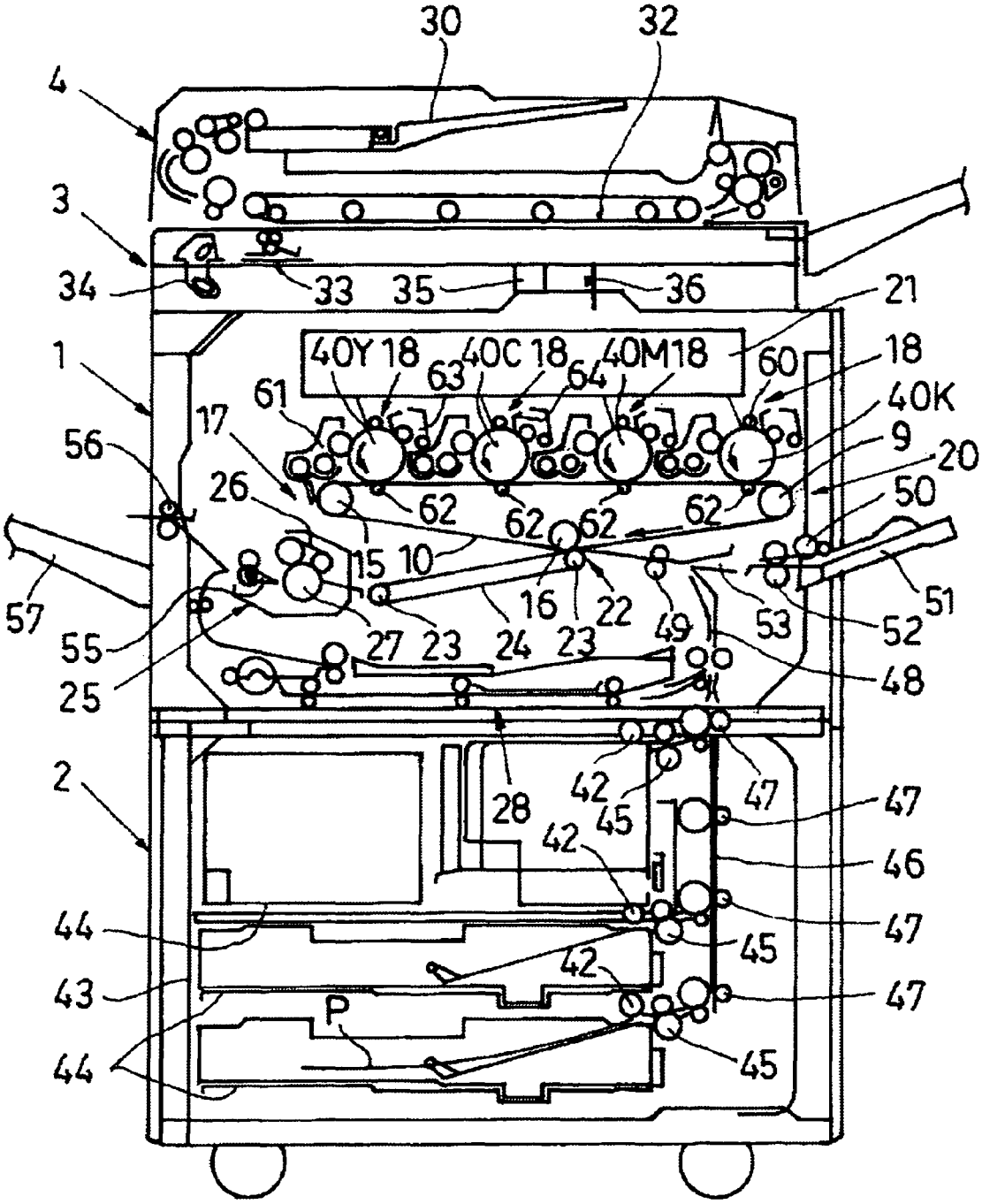
FIG. 2 is a diagram of an example of an image forming apparatus including the transfer apparatus.

FIG. 1 is a diagram of a transfer apparatus, together with a control system and a plurality of photosensitive elements, according to a first embodiment of the present invention. FIG. 2 is a diagram of an example of an image forming apparatus including the transfer apparatus.

The image forming apparatus shown in FIG. 2 is a tandem type electrophotographic device using an endless intermediate transfer belt 10 (hereinafter, "transfer belt 10"). The image forming apparatus will be assumed to be a copying machine. A body 1 of the copying machine is placed on a paper feed table 2. A scanner 3 is mounted on the body 1, and an automatic document feeder (ADF) 4 is mounted on the scanner 3.

A transfer apparatus 20 that includes the transfer belt 10 is provided at substantially the central part of the body 1. The transfer belt 10 is supported by a drive roller 9 and two driven rollers 15 and 16 so as to move clockwise (see FIG. 2). Toner remaining on the surface of the transfer belt 10 after an image is transferred is cleaned off by a cleaning device 17 that is provided on the left side of the driven roller 15.

Drum-shaped photosensitive elements 40Y, 40C, 40M, and 40K (hereinafter, "photosensitive drums 40Y, 40C, 40M, and 40K" or "photosensitive drums 40" unless otherwise specified) forming four imaging units 18 of yellow, cyan, magenta, and black are provided above a linear part of the transfer belt 10 wound around between the drive roller 9 and the driven roller 15 so as to be rotatable in the counterclockwise in FIG. 2, along the direction of the movement of the transfer belt 10. Provided around each of the photosensitive drums 40 are a charger 60, a developing device 61, a primary transfer device 62, a photosensitive-drum cleaning device 63, and a decharger 64, respectively. An exposing device 21 is provided above the photosensitive drums 40.

On the other hand, a secondary transfer device 22 is provided under the transfer belt 10. The secondary transfer device 22 is realized by an endless secondary transfer belt 24 that is wound around and between two rollers 23 and 23. The secondary transfer belt 24 is pushed against the driven roller 16 through the transfer belt 10. The secondary transfer device 22 collectively transfers toner images on the transfer belt 10 to a sheet P as a recording material fed to a space between the secondary transfer belt 24 and the transfer belt 10.

A fixing device 25 for fixing the toner images on the sheet P is provided on the downstream side of the secondary transfer device 22 in the direction of the sheet conveyance. A pushing roller 27 is pushed against a fixing belt 26 as an endless belt in the fixing device 25.

The secondary transfer device 22 serves also as a function of conveying the sheet with the image thereon to the fixing device 25. The secondary transfer device 22 may be a transfer device using a transfer roller and a non-contact type charger.

A sheet reversing unit 28 is provided under the secondary transfer device 22. The sheet reversing unit 28 reverses the sheet to form images on both surfaces of the sheet.

When color copying is to be performed in the color copying machine, a document is placed on a document table 30 of the ADF 4. When a document is manually placed, the ADF 4 is opened, the document is placed on a contact glass 32 of the scanner 3, and the ADF 4 is closed to retain the document.

By pressing a start switch (not shown), the document placed on the ADF 4 is sent to the contact glass 32. When the document is manually placed on the contact glass 32, the scanner 3 is immediately driven, and a first running element 33 and a second running element 34 start running. Light is emitted to the document from a light source disposed in the first running element 33, and the light reflected from the surface of the document is directed toward the second running element 34, and is reflected by a mirror disposed in the second running element 34 to pass through an imaging lens 35, and the light enters into a reading sensor 36 to read the contents of the document.

By pressing the start switch, the transfer belt 10 starts moving. At the same time, the photosensitive drums 40 start rotating, and the operation of forming respective single color images of yellow, cyan, magenta, and black on the photosensitive drums 40 is started. The color images on the photosensitive drums 40 are sequentially transferred superposedly to the transfer belt 10 moving in the clockwise in FIG. 2, and a full color composite image is formed.

On the other hand, pressing the start switch allows a paper feed roller 42 of a selected paper feed stage in the paper feed table 2 to rotate, a sheet P is sent out from a paper feed cassette 44 selected from a paper bank 43, and the sheet P is separated one by one by a separation roller 45 and is conveyed to a paper feed path 46.

The sheet P is conveyed to a paper feed path 48 in the body 1 of the copying machine by conveying rollers 47, and abuts on registration rollers 49 to stop once.

When a sheet is a manually fed, the sheet P placed on the manual feed tray 51 is sent out through the rotation of a paper feed roller 50. The sheet P is separated one by one by a separation roller 52 and is conveyed to a manual feed path 53, and abuts on the registration rollers 49 to stop once.

The registration rollers 49 start rotation at an accurate timing to match the composite color image on the transfer belt 10, and feed the sheet P being at rest temporarily to a space between the transfer belt 10 and the secondary transfer device 22. Then, the color image is transferred to the sheet P by the secondary transfer device 22.

The sheet P with the image thereon is conveyed to the fixing device 25 by the secondary transfer device 22 having also a function as a conveying device. The image on the sheet P is fixed by being applied with heat and pressure at the fixing device 25. The sheet P with the image fixed thereon is guided to a discharge side by a switching claw 55, and is discharged onto a paper discharge tray 57 by discharge rollers 56 to be stacked thereon.

When a two-sided copy mode is selected, the sheet P with an image formed on one surface thereof is conveyed to the sheet reversing unit 28 by the switching claw 55, and is reversed to be guided again to the transfer position. Another image is formed on the rear surface thereof at the transfer position this time, and the sheet P is discharged to the paper discharge tray 57 by the discharge rollers 56.

Figure 3:
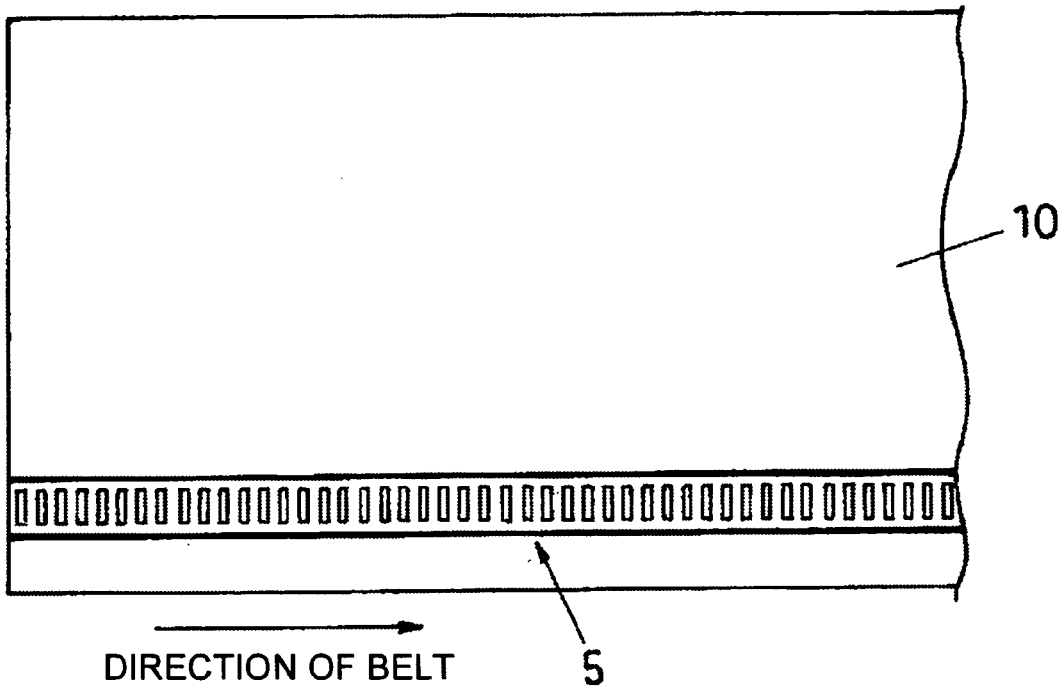
FIG. 3 is a plan view of a part of an intermediate transfer belt.

As shown in FIG. 1, the transfer apparatus 20 includes the transfer belt 10, a sensor 6, and a control device 70. Specifically, images on the four photosensitive drums 40Y, 40C, 40M, and 40K are sequentially transferred to the transfer belt 10 so as to be superposed on one another while the transfer belt 10 is rotated. The sensor 6 reads a scale 5 arranged along the whole circumference of the internal surface of the transfer belt 10. See FIG. 3 because only a part of the scale is shown in FIG. 1. The control device 70 detects an actual speed of the transfer belt 10 from information obtained by detecting the scale 5 by the sensor 6, and corrects the speed of the transfer belt 10 according to the actual speed.

Figure 4:
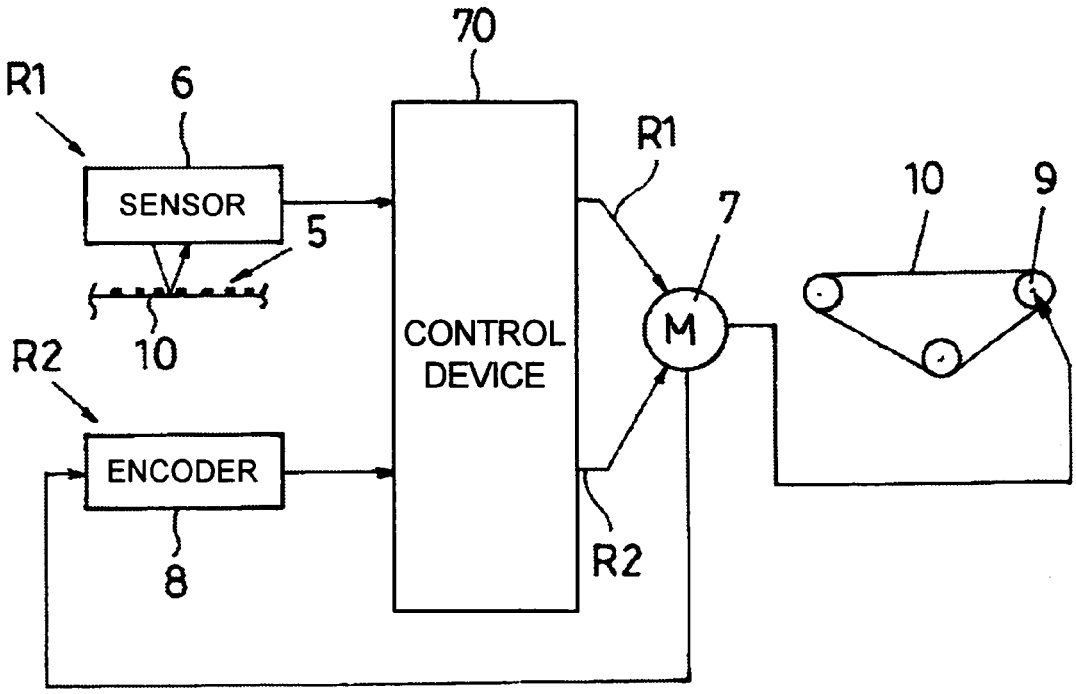
FIG. 4 is a block diagram of two control loops included in the transfer apparatus.

The transfer apparatus 20 further includes a normal speed control loop (hereinafter, "primary control loop") R1 and a control loop used on occurrence of abnormality (hereinafter, "secondary control loop") R2. The primary control loop R1 detects an actual speed of the transfer belt 10 from information obtained by detecting the scale 5 by the sensor 6 to correct the speed of the transfer belt 10 according to the actual speed, as shown in FIG. 4. The secondary control loop R2 is used when an abnormality occurs in the primary control loop R1.

The secondary control loop R2 includes an encoder 8 as a speed detector provided therein. The speed detector detects the number of revolutions of a belt drive motor 7 that rotates the transfer belt 10 as shown in FIG. 1. The secondary control loop R2 corrects the moving speed of the transfer belt 10 according to the number of revolutions of the belt drive motor 7 detected by the encoder 8.

Figure 5:
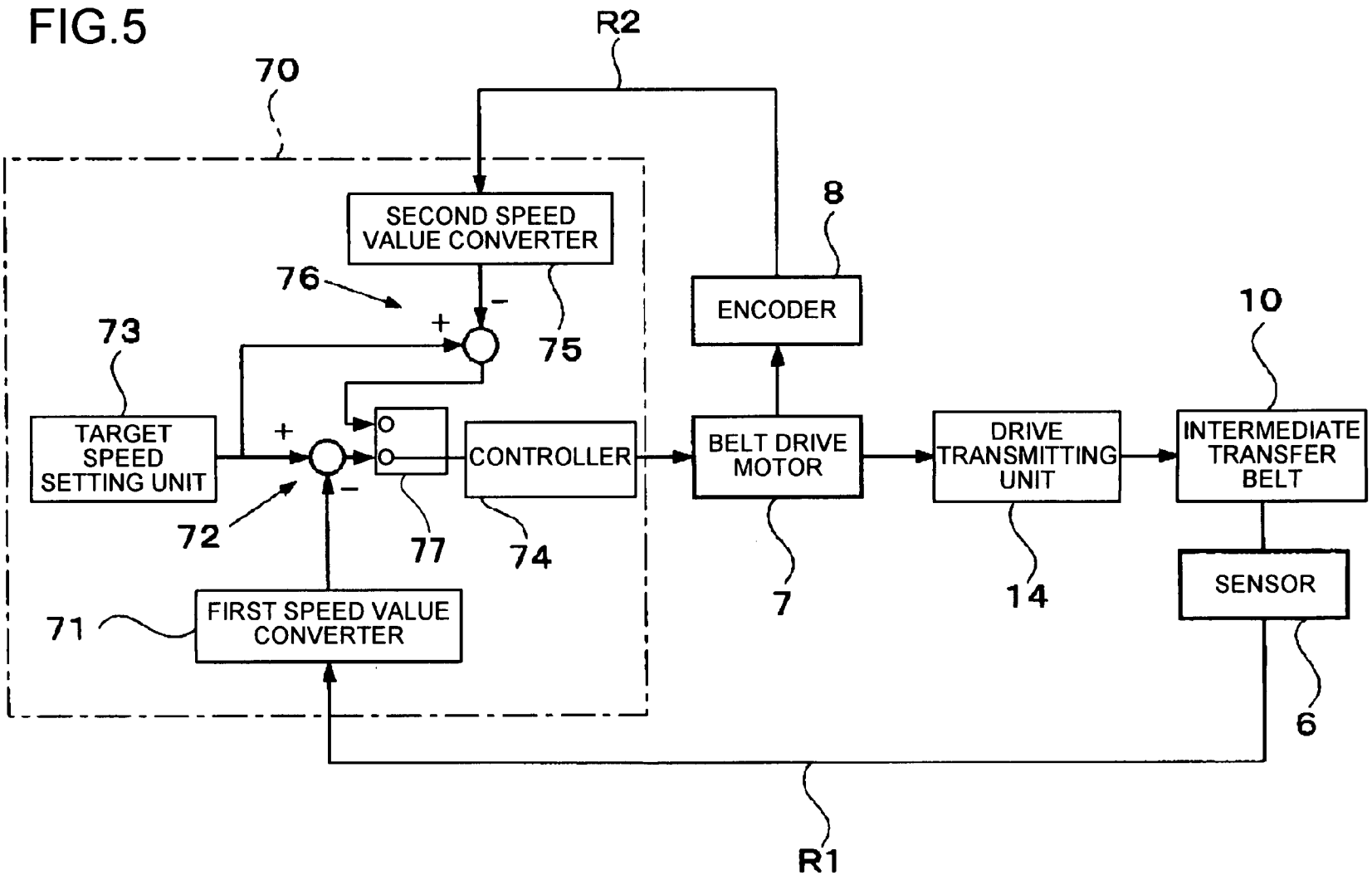
FIG. 5 is a block diagram of a normal speed control loop (primary control loop) and a control loop used on occurrence of abnormality (secondary control loop) as the two control loops for explanation in further detail.

FIG. 5 is a block diagram of the primary control loop R1 and the secondary control loop R2 for explanation in further detail.

In the primary control loop R1, the sensor 6 reads the scale 5 (FIG. 3) on the transfer belt 10, and the read value is input to a first speed value converter 71 that forms a motor controller of the control device 70. Accordingly, a signal output from the sensor 6 is asynchronous with the operation of the motor controller, but the signal is converted to a synchronous signal level by the first speed value converter 71. The first speed value converter 71 converts an input detected information to a speed value (which becomes an actual speed of the transfer belt 10), and outputs the speed value to a first arithmetic unit 72.

The first arithmetic unit 72 also receives a signal corresponding to a target speed from a target speed setting unit 73 that sets the target speed as a basic speed of the transfer belt 10. The first arithmetic unit 72 compares the input actual speed of the transfer belt 10 with the input target speed. If the actual speed and the target speed are not the same, the first arithmetic unit 72 outputs a signal to control the number of revolutions of the belt drive motor 7 to a controller 74 so that the speed of the transfer belt 10 becomes the target speed. Then, the transfer belt 10 is made to rotate through a drive transmitting unit 14 including the drive roller 9 so that the speed becomes the target speed.

The primary control loop R1 performs feedback control so that the speed of the transfer belt 10 becomes the target speed.

On the other hand, in the secondary control loop R2, the encoder 8 detects the number of revolutions of the belt drive motor 7 and transmits detected information to a second speed value converter 75. The second speed value converter 75 converts the detected information corresponding to the input actual speed of the transfer belt 10 to a speed value, and outputs the speed value to a second arithmetic unit 76.

The second arithmetic unit 76 also receives a signal corresponding to the target speed of the transfer belt 10 from the target speed setting unit 73. Then, the second arithmetic unit 76 compares the input actual speed of the transfer belt 10 with the input target speed. If there is a difference between the actual speed and the target speed, the second arithmetic unit 76 outputs a signal to control the number of revolutions of the belt drive motor 7 to the controller 74 so that the speed of the transfer belt 10 becomes the target speed. Then, the controller 74 controls the transfer belt 10 so that the speed thereof becomes the target speed.

The secondary control loop R2 performs feedback control so that the speed of the transfer belt 10 becomes the target speed in the above manner.

It is noted that a direct-current (DC) (alternating-current (AC)) three-phase motor is used for the belt drive motor 7 in the first embodiment.

The torque of the belt drive motor 7 is transmitted to the drive roller 9 that rotatably supports the transfer belt 10 as shown in FIG. 1, and drives it. A frictional force increasing unit is provided along the circumferential surface of the drive roller 9 to obtain a nonskid surface of the drive roller 9 with respect to the transfer belt 10.

The frictional force increasing unit makes the transfer belt 10 harder to slip over the drive roller 9 by forming a number of knurled grooves on the circumferential surface of the drive roller 9, or by uniformly coating a material having characteristics of increasing frictional force, over the circumferential surface of the drive roller 9.

The transfer belt 10 is made of, for example, fluororesin, polycarbonate resin, and polyimide resin, or is an elastic belt obtained by forming the whole layer or a part of the transfer belt 10 with an elastic material.

The belt drive motor 7 rotates the drive roller 9 to allow the transfer belt 10 to rotate in the direction of arrow C. However, the torque during the operation may be transmitted directly to the drive roller 9, or may be transmitted thereto through a gear.

Different single color images (toner images) formed on the photosensitive drums 40Y, 40C, 40M, and 40K are sequentially transferred to the transfer belt 10 so as to be superposed on one another.

The scale 5 is formed along the internal surface of the transfer belt 10 so that the scale marks are arranged at uniform intervals along the whole circumference thereof. The scale 5 may be formed along the external surface of the transfer belt 10. However, it is preferable to provide the scale 5 on the internal surface rather than the external surface where an image is formed. Furthermore, the sensor 6 may be disposed at any location if the scale 5 on the surface of the transfer belt 10 at a particular portion, that is, at a linearly stretched portion can be detected.

Figure 6:
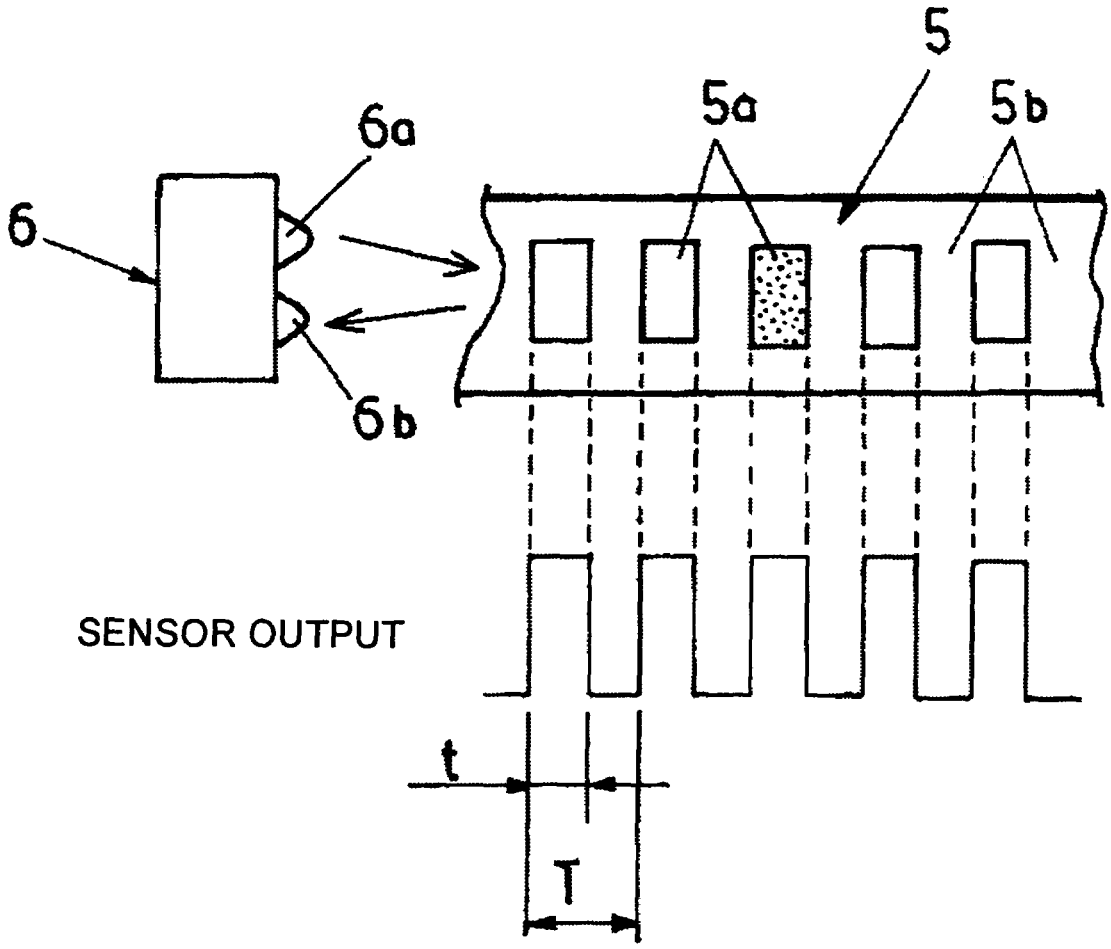
FIG. 6 is a diagram of a sensor for reading the scale and a sensor signal output from the sensor.

As shown in FIG. 6, the sensor 6 is a reflective type optical sensor including a light emitting element 6*a* and a light receiving element 6*b*. The light emitted from the light emitting element 6*a* is reflected by the scale 5, and the light reflected thereby is received by the light receiving element 6*b*. The amount of the light reflected by slit parts 5*a* of the scale 5 and the amount of the light reflected by the rest 5*b* of the scale 5 are differently detected.

In other words, the sensor 6 outputs two signals at a high level and a low level based on a difference in reflectance between the slit parts 5*a* and the rest 5*b*.

However, there arises a problem here such that, for example, toner fly-off within the body 1 of the copying machine (FIG. 2) is deposited on the scale 5 as indicated by dots in FIG. 6 and the scale 5 is contaminated with time. When the scale 5 is deposited with the toner or the like (oil may be deposited during maintenance), the amount of reflected light is impossible to be accurately detected with such a scale 5 even if the scale marks are finely and accurately arranged thereon.

Therefore, even if the primary control loop R1 using the sensor 6 is used in such a state and feedback control is performed so as to convert the speed of the transfer belt 10 to the target speed, it is impossible to control the speed of the transfer belt 10 to be an accurate moving speed. If a full color image is formed in such a state, four-color toner images transferred to the transfer belt 10 are deviated from one another. Therefore, the color misalignment and the change in hue occur in the color image to cause image quality to be degraded.

The transfer apparatus 20 of FIG. 1 and the image forming apparatus including the transfer apparatus 20 have the secondary control loop R2 provided for the case where an abnormality occurs in the primary control loop R1 as explained above, and the method of correcting the moving speed of the belt as explained below is implemented. Therefore, even in the event that an abnormality occurs in the primary control loop R1, the transfer belt 10 is feedback-controlled so as to achieve the target speed.

The control device 70 shown in FIG. 1 and FIG. 4 performs all the controls. More specifically, the control loops are switched by a switching circuit 77 (FIG. 5). The control device 70 includes a microcomputer that has a central processing unit (CPU) having functions of performing various determinations and processing, a read only memory (ROM) storing processing programs and fixed data, a random access memory (RAM) as data memory that stores processing data, and an input-output (I/O) circuit.

Figure 7:
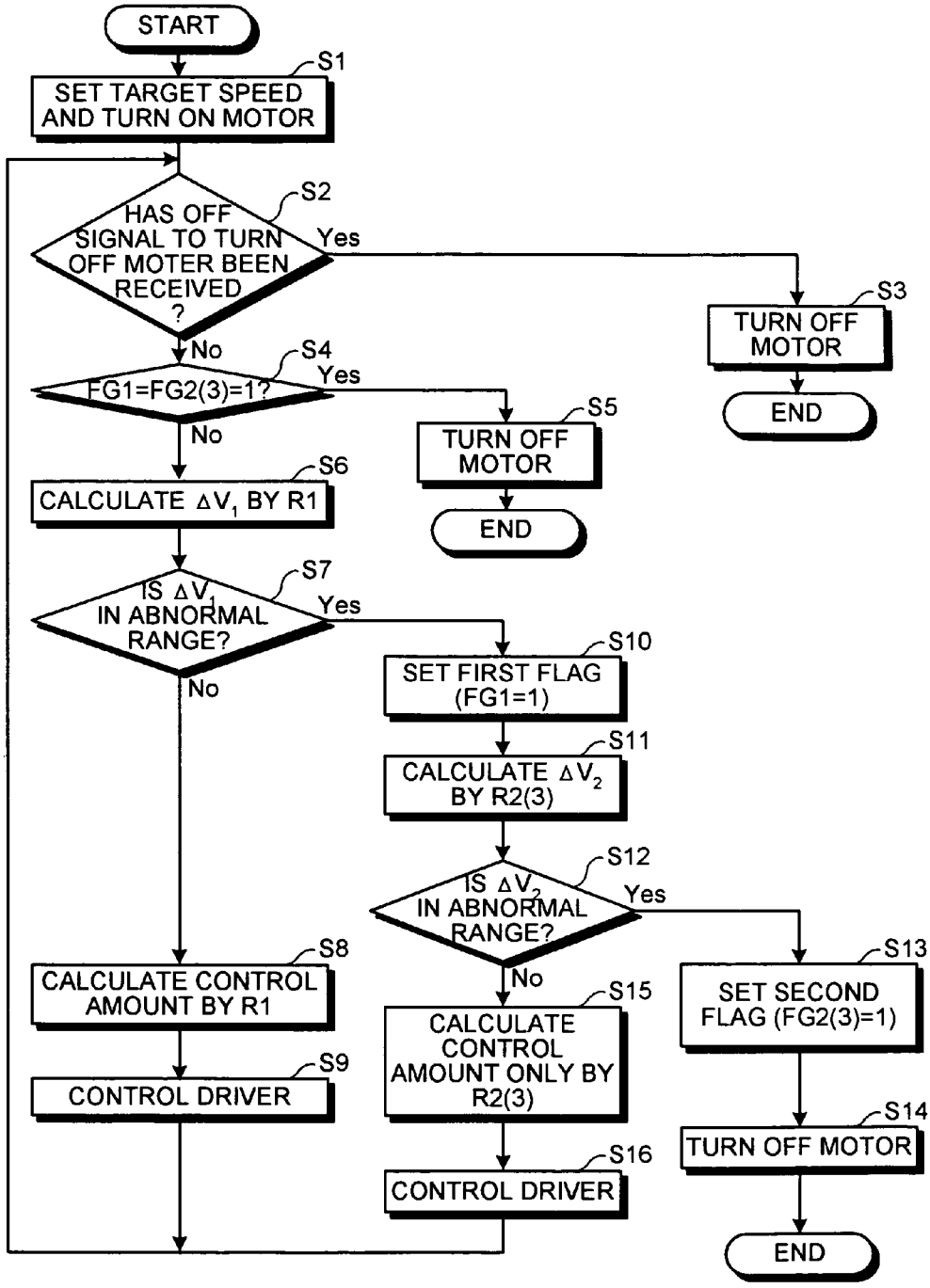
FIG. 7 is a flowchart of a routine of belt speed control implemented by a microcomputer included in the control device of the first embodiment.

The microcomputer of the control device 70 starts the routine of the processing of belt speed control as shown in FIG. 7 at a predetermined timing.

At step S1, a target speed V is set for the belt drive motor 7, and the belt drive motor 7 is turned on. At step S2, it is determined whether an OFF signal to turn off the belt drive motor 7 has been received. If the OFF signal has been received, the process proceeds to step S3 where the belt drive motor 7 is turned off, and the processing is ended. If the OFF signal has not been received, the process proceeds to step S4 where it is determined whether abnormalities occur in both the primary control loop R1 and the secondary control loop R2. In other words, it is determined whether FG1=FG2=1, where FG1 is a flag indicating whether an abnormality occurs in the primary control loop R1, and 1 is set in FG1 when the abnormality occurs therein, and FG2 is a flag indicating whether an abnormality occurs in the secondary control loop R2, and 1 is set in FG2 when the abnormality occurs therein.

If it is determined that the abnormalities occur in both the primary control loop R1 and the secondary control loop R2, i.e., Yes (Y in flowcharts), the process proceeds to step S5 where the belt drive motor 7 is turned off, and the processing is ended. If it is determined as No (N in flowcharts) at step S4, the process proceeds to step S6 where the actual speed of the transfer belt 10 detected by using the primary control loop R1 is compared with the target speed V to calculate a first speed difference $\Delta V_1$ between the actual speed and the target speed V.

At step S7, it is determined whether the first speed difference $\Delta V_1$ is in an abnormal range or whether the first speed difference $\Delta V^1$ is in an allowable range. If it is beyond the allowable range (e.g., it exceeds 10% with respect to the target speed), the process proceeds to step S10, while if it is within the allowable range, the process proceeds to step S8.

At step S8, a control amount to control the belt drive motor 7 is calculated so that the speed of the transfer belt 10 having the first speed difference $\Delta V_1$ becomes the target speed V. At step S9, a driver is controlled according to the control amount.

On the other hand, if it is determined at step S7 that the primary control loop R1 is abnormal and the process proceeds to step S10, a first abnormality detected flag (hereinafter, "first flag") is set at step S10 (FG1=1), and the process proceeds to step S11. At step S11, only the secondary control loop R2 is used to detect an actual speed of the transfer belt 10, and the actual speed is compared with the target speed V to calculate a second speed difference $\Delta V_2$ between the actual speed and the target speed V.

At step S12, it is determined whether the second speed difference $\Delta V_2$ is in the abnormal range or whether the second speed difference $\Delta V_2$ is in the allowable range. If it is beyond the allowable range (e.g., it exceeds 10% with respect to the target speed), the process proceeds to step S13. At step S13, a second abnormality detected flag (hereinafter, "second flag") is set (FG2=1), and at step S14, the belt drive motor 7 is turned off, and the processing is ended.

At step S12, if the second speed difference $\Delta V_2$ is within the allowable range, the process proceeds to step S15. At step S15, only the secondary control loop R2 is used to calculate a control amount to control the belt drive motor 7 so that the speed of the transfer belt 10 having the second speed difference $\Delta V_2$ becomes the target speed V. At step S16, the driver is controlled according to the control amount. The process then returns to step S2, and the determining and processing operations at step S2 and thereafter are repeated.

If the OFF signal to turn off the belt drive motor 7 is received at step S2, the process proceeds from step S2 to step S3, and the processing is ended.

If abnormalities are detected in both the primary control loop R1 and the secondary control loop R2, the process proceeds to step S7→step S10→step S11→step S12→step S13→step S14, and the processing is ended.

As explained above, when the primary control loop R1 is normally operated, the control device 70 of FIG. 1 corrects the speed of the transfer belt 10 according to only the difference between the actual speed of the transfer belt 10 detected based on the scale 5 (FIG. 3) and the target speed V thereof.

The secondary control loop R2 is used only when an abnormality occurs in the primary control loop R1.

Therefore, when no abnormality is detected in the primary control loop R1, the primary control loop R1 is used rather than the secondary control loop R2. Because the primary control loop R1 directly detects the scale 5 (FIG. 3) provided along the internal surface of the transfer belt 10 to obtain higher detection accuracy in the moving speed of the transfer belt 10 than that of the secondary control loop R2 for indirectly detecting the moving speed of the transfer belt 10 from the rotation axis of the belt drive motor 7.

Figure 8:
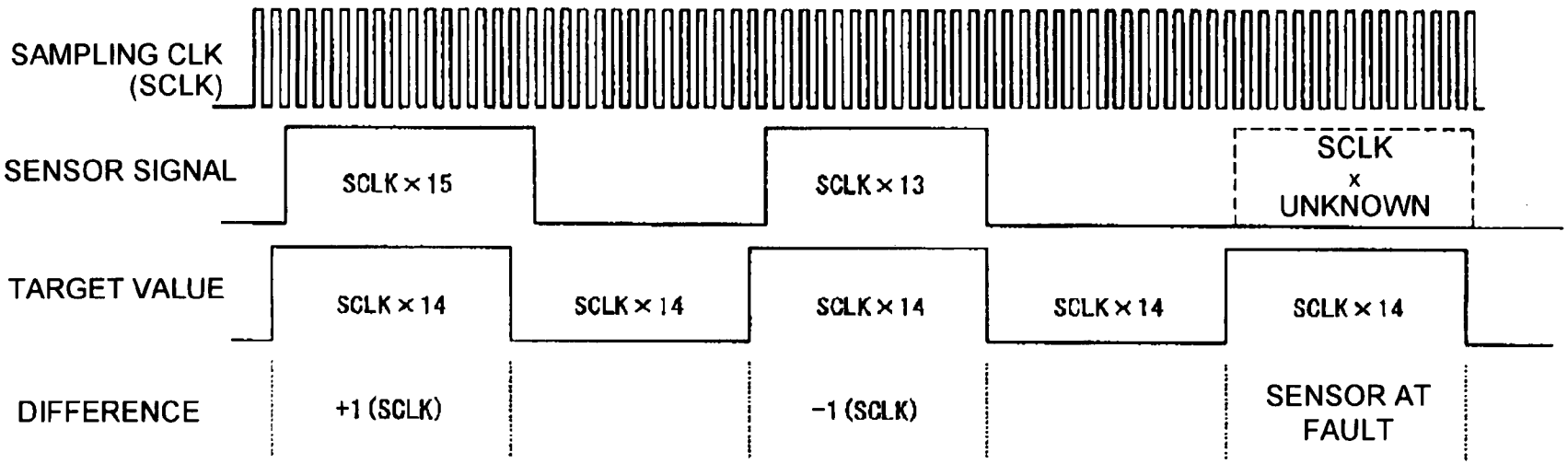
FIG. 8 is a diagram to explain how to determine an erroneous detection of the sensor due to contamination of the belt.

FIG. 8 is a diagram of an example of how to determine an erroneous detection of the sensor 6 due to contamination of the belt 10.

In the method of determining an erroneous detection of the sensor, sampling clocks (SCLKs) as a reference are used to set a target speed of the transfer belt 10. In the example of FIG. 8, 14 SCLKs are used to set the target speed.

A signal input from the sensor 6 (FIG. 1) is synchronized with SCLKs to generate a synchronous sensor signal. At first, it is determined how many SCLKs the sensor signal corresponds to. If the number of SCLKs is greater than a target value, then it is determined that the speed of the transfer belt 10 is slow. If it is less than the target value, then it is determined that the speed of the transfer belt 10 is fast. If the sensor 6 erroneously detects the scale 5 (FIG. 3) due to toner contamination on the scale 5, the synchronous sensor signal corresponds to twice or more of the SCLK. At this time, it is determined in the method that the belt 10 is contaminated.

The determination is given when the difference between the speed and the target speed of the transfer belt 10 becomes several percents with respect to the target speed. Further, to enhance the accuracy, an increase in SCLK and an increase in resolution are effective. A detection signal of the secondary control loop R2 (FIG. 1) is also used to determine whether abnormalities occur in the belt speed and the feedback signal.

Figure 9:
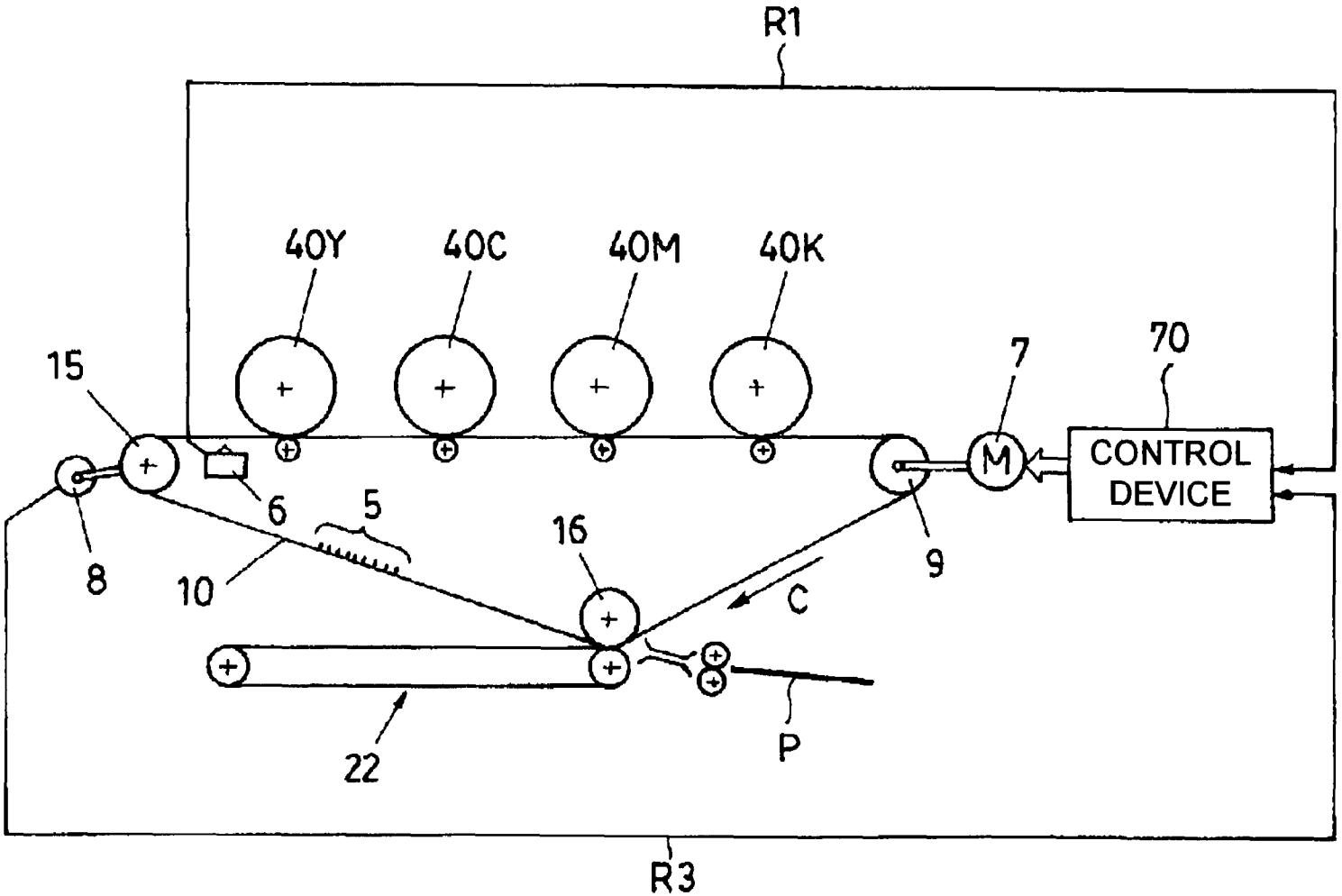
FIG. 9 is a diagram of a transfer apparatus, together with a control system, according to a second embodiment of the present invention.
Figure 10:
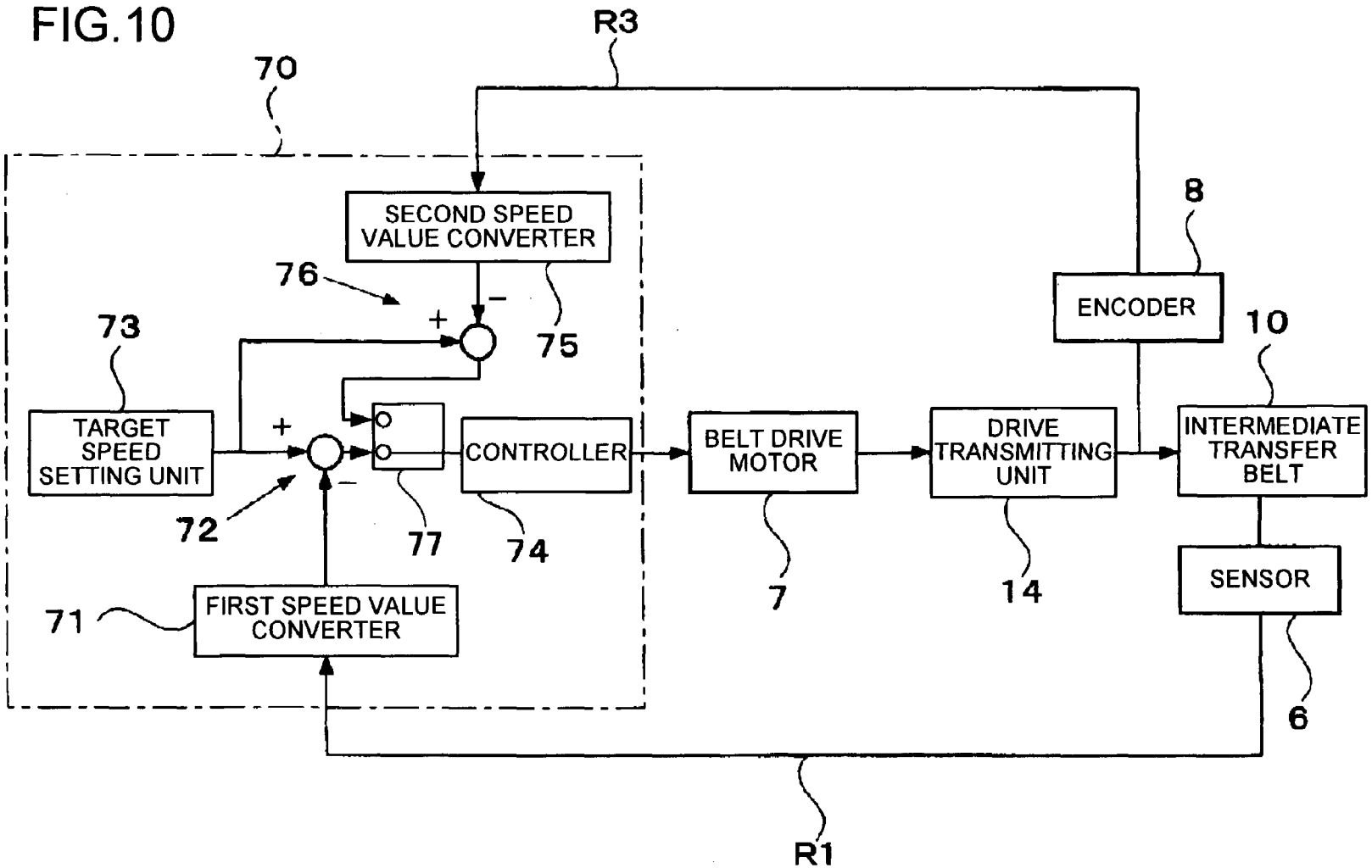
FIG. 10 is a block diagram of two control loops included in the transfer apparatus.

FIG. 9 is a diagram of a transfer apparatus of an image forming apparatus that detects a speed of the transfer belt 10 from the number of revolutions of a driven roller 15 for supporting the transfer belt 10, together with a control system as shown in FIG. 1, according to a second embodiment of the present invention. FIG. 10 is a block diagram of two control loops included in the image forming apparatus.

The image forming apparatus according to the second embodiment is different, from the image forming apparatus of FIG. 2, only in that the moving speed of the transfer belt 10 is detected from the rotating speed of the driven roller 15 that supports the transfer belt 10. Therefore, the illustration of the overall configuration of the image forming apparatus and explanation thereof are omitted, and only the difference is explained below.

The transfer apparatus of the image forming apparatus includes another control loop used on occurrence of abnormality (hereinafter, "tertiary control loop") R3 that is used when an abnormality occurs in the primary control loop R1, the same as that explained in the first embodiment by referring to FIG. 1 to FIG. 7. The tertiary control loop R3 includes the encoder 8 as a speed detector that detects the number of revolutions of the driven roller 15 for rotatably supporting the transfer belt 10. The tertiary control loop R3 detects an actual speed of the transfer belt 10 from the number of revolutions of the driven roller 15 and corrects the speed of the transfer belt 10 according to the result of detection.

The processing implemented by the microcomputer of the control device 70 in the second embodiment is the same as that of the flowchart explained with reference to FIG. 7. Therefore, only FG3 is substituted for FG2 and R3 is substituted for R2 in FIG. 7, and the illustration and detailed explanation thereof are omitted. It is noted that FG3 is a flag indicating whether an abnormality occurs in the tertiary control loop R3, and 1 is set in FG3 when the abnormality occurs therein.

Only one point of using the encoder 8 is different from the first embodiment. The encoder 8 detects the number of revolutions of the driven roller 15 for detection of an actual speed of the transfer belt 10 by using the tertiary control loop R3 performed from step S7 to step S16 in FIG. 7.

In other words, when the process proceeds to step S11 the routine of FIG. 7, the microcomputer of the control device 70 detects the actual speed of the transfer belt 10 by using only the tertiary control loop R3. At this time, the number of revolutions of the driven roller 15 is detected by the encoder 8 as shown in FIG. 9 to detect the actual speed of the transfer belt 10.

The processing and determining operation after the above step are the same as those explained with reference to FIG. 7. The actual speed is compared with the target speed V to calculate a second speed difference $\Delta V_2$ between the actual speed and the target speed V. It is determined whether the second speed difference $\Delta V2$ is in the abnormal range. If it is determined that the second speed difference $\Delta V_2$ is in the allowable range, only the tertiary control loop R3 is used to calculate a control amount to control the belt drive motor 7 so that the speed of the transfer belt 10 having the second speed difference $\Delta V_2$ becomes the target speed V. The driver is controlled according to the control amount.

As explained above, in the second embodiment, detection of the actual speed of the transfer belt 10 using the tertiary control loop R3 is implemented by detecting the number of revolutions of the driven roller 15. Therefore, it is possible to indirectly detect the actual speed of the transfer belt 10 at a position closer to the transfer belt 10 as compared with the case where the number of revolutions of the belt drive motor 7 is detected. Thus, the detection accuracy is improved.

Figure 11:
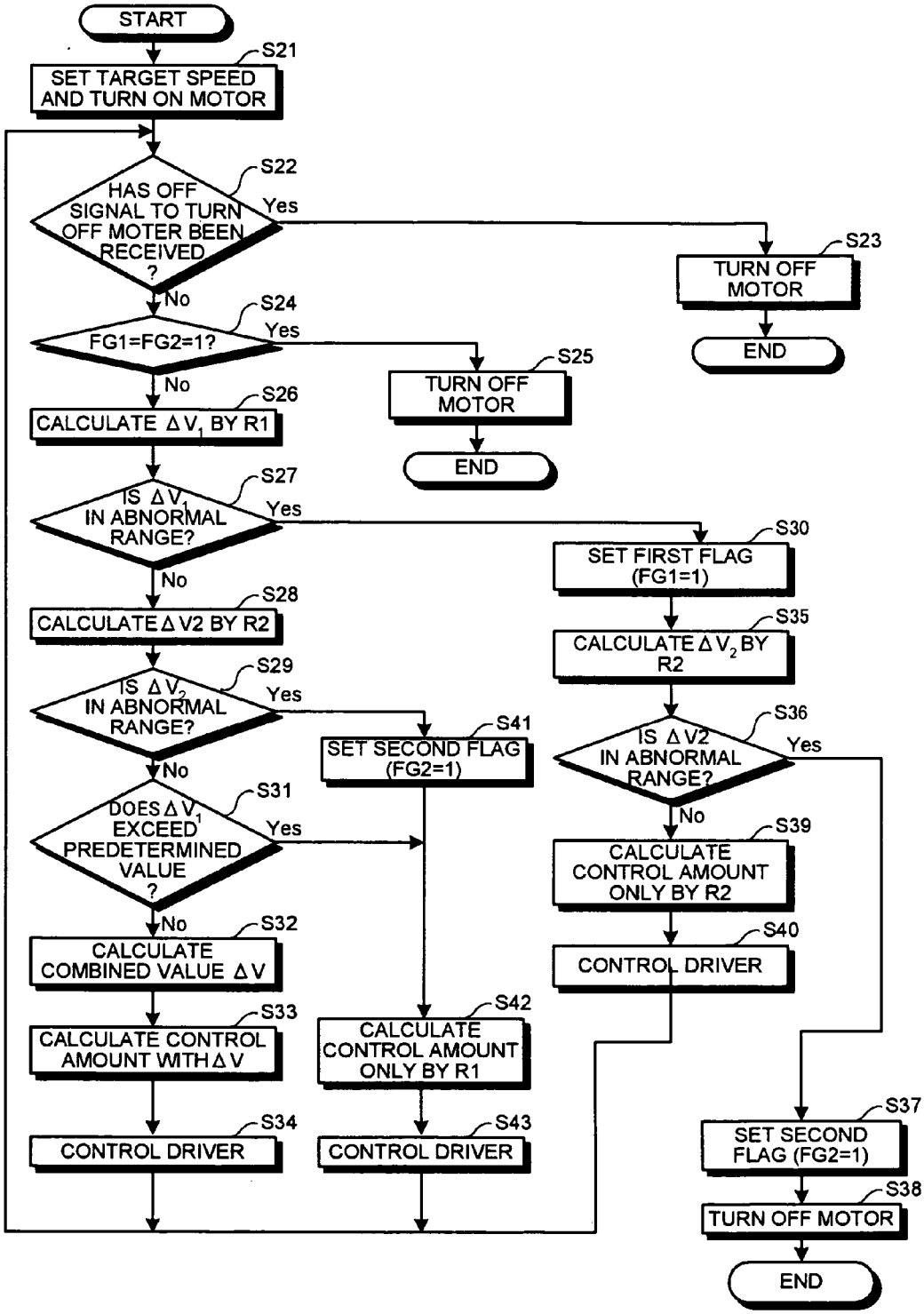
FIG. 11 is a flowchart of operation of an image forming apparatus according to a third embodiment of the present invention.

FIG. 11 is a flowchart with respect to the operation of an image forming apparatus including a transfer apparatus that controls a belt speed according to a difference between an actual speed and a target speed of the belt detected respectively by the primary control loop and the secondary control loop, according to a third embodiment of the present invention.

The components and the control system of the transfer apparatus and the image forming apparatus of the third embodiment are the same as those explained with reference to FIG. 1 and FIG. 2. Therefore, the illustration and the explanation thereof are omitted (but FIG. 1 and FIG. 2 are referred to as required). Only the processing implemented by the microcomputer of a control device (which is configured the same as that of the control device 70) is explained. The processing is implemented following the method of correcting the moving speed of the belt 10.

In the microcomputer of the control device 70, if both the primary control loop R1 and the secondary control loop R2 are normally operated but a first speed difference $\Delta V_1$ exceeds a predetermined value, the microcomputer controls the speed of the transfer belt 10 according to a combined value of the first speed difference $\Delta V_1$ and a second speed difference $\Delta V_2$. More specifically, the first speed difference $\Delta V_1$ is obtained between the actual speed of the transfer belt 10 detected based on the scale 5 and a target speed thereof, and the second speed difference $\Delta V_2$ is obtained between an actual speed of the transfer belt 10 detected by the secondary control loop R2 and the target speed of the transfer belt 10. In other words, in the third embodiment, the control device 70 functions as a control unit that corrects the speed of the transfer belt 10 according to the combined value.

The microcomputer of the control device 70 starts the routine of the processing of belt speed control as shown in FIG. 11 at a predetermined timing.

At step S21, a target speed V is set for the belt drive motor 7, and the belt drive motor 7 is turned on. At step S22, it is determined whether an OFF signal to turn off the belt drive motor 7 has been received. If the OFF signal has been received, the process proceeds to step S23 where the belt drive motor 7 is turned off, and the processing is ended. If the OFF signal has not been received, the process proceeds to step S24 where it is determined whether abnormalities occur in both the primary control loop R1 and the secondary control loop R2, that is, it is determined whether FG1=FG2=1.

If it is determined at step that abnormalities occur therein, i.e., Yes, the process proceeds to step S25 where the belt drive motor 7 is turned off, and the processing is ended. If it is determined as No at step S24, the process proceeds to step S26 where an actual speed of the transfer belt 10 detected by using the primary control loop R1 is compared with the target speed V to calculate a first speed difference $\Delta V_1$ between the actual speed and the target speed V.

At step S27, it is determined whether the first speed difference $\Delta V_1$ is in an abnormal range or whether the first speed difference $\Delta V_1$ is in an allowable range, for example, within 10% with respect to the target speed. If it is beyond the allowable range, the process proceeds to step S30, while if it is within the allowable range, the process proceeds to step S28. At step S28, the actual speed of the transfer belt 10 detected by using the secondary control loop R2 is compared with the target speed V to calculate a second speed difference $\Delta V_2$ between the actual speed and the target speed V.

At step S29, it is determined whether the second speed difference $\Delta V_2$ is in the abnormal range or whether the second speed difference $\Delta V_2$ is in the allowable range, for example, within 10% with respect to the target speed. If it is beyond the allowable range, the process proceeds to step S41, while if it is within the allowable range, the process proceeds to step S31.

At step S31, it is determined whether the first speed difference $\Delta V_1$ exceeds a predetermined value (explained in detail later) that is set with a value within the allowable range with respect to the target speed. If it is within the predetermined value, the process proceeds to step S42, while if it exceeds the predetermined value, the process proceeds to step S32.

At step S32, a combined value $\Delta V$ of the first speed difference $V_1$ and the second speed difference $\Delta V_2$ is calculated. At step S33, a control amount to control the belt drive motor 7 according to the combined value $\Delta V$ is calculated so that the speed of the transfer belt 10 having the first speed difference $\Delta V_1$ and the second speed difference $\Delta V_2$ becomes the target speed V. At step S34, a driver is controlled according to the control amount.

On the other hand, if it is determined at step S27 that the first speed difference $\Delta V_1$ is within the abnormal range, the process proceeds to step S30 (when the primary control loop R1 is abnormal) where the first flag is set at step S30 (FG1=1), and the process proceeds to step S35. At step S35, only the secondary control loop R2 is used to detect an actual speed of the transfer belt 10, and the actual speed is compared with the target speed V to calculate a second speed difference $\Delta V_2$ between the actual speed and the target speed V.

At step S36, it is determined whether the second speed difference $\Delta V_2$ is in the abnormal range or whether the second speed difference $\Delta V_2$ is in the allowable range (e.g., it is within 10% with respect to the target speed). If it is beyond the allowable range, the process proceeds to step S37. At step S37, the second flag is set (FG2=1), and at step S38, the belt drive motor 7 is turned off, and the processing is ended.

At step S36, if the second speed difference $\Delta V_2$ is within the allowable range, the process proceeds to step S39. At step S39, only the secondary control loop R2 is used to calculate a control amount to control the belt drive motor 7 so that the speed of the transfer belt 10 having the second speed difference $\Delta V_2$ becomes the target speed V. At step S40, the driver is controlled according to the control amount. The process then returns to step S22, and the determining and processing operations at step S22 and thereafter are repeated.

Further, at step S29, if it is determined that the second speed difference $\Delta V_2$ is in the abnormal range, then the process proceeds to step S41. At step S41, the second flag is set (FG2=1), and at step S42, only the primary control loop R1 is used to calculate a control amount to control the belt drive motor 7 so that the speed of the transfer belt 10 having the first speed difference $\Delta V_1$ becomes the target speed V. At step S43, the driver is controlled according to the control amount. The process then returns to step S22, and the determining and processing operations at step S22 and thereafter are repeated.

If the OFF signal to turn off the belt drive motor 7 is received at step 22, the process proceeds from step S22 to step S23, and the processing is ended.

If abnormalities are detected in both the primary control loop R1 and the secondary control loop R2, the process also proceeds to step S27→step S30→step S35→step S36→step S37→step S38, and the processing is ended.

As explained above, when an abnormality occurs in the primary control loop R1, the speed of the transfer belt 10 is corrected only by the secondary control loop R2.

If an abnormality occurs in the secondary control loop R2 during correction of the speed of the transfer belt 10 only by the secondary control loop R2, the transfer belt 10 is stopped.

Furthermore, assume that the primary control loop R1 and the secondary control loop R2 are normally operated. Under such situation, if an abnormality occurs in the secondary control loop R2 during correction of the speed of the transfer belt 10 according to the combined value $\Delta V$ of the first speed difference $\Delta V_1$ and the second speed difference $\Delta V_2$, the speed of the transfer belt 10 is corrected only by the primary control loop R1.

Therefore, even if the scale 5 (FIG. 3) is contaminated with toner or the like, the transfer belt 10 can be continuously driven at a normal moving speed unless an abnormality occurs in the secondary control loop R2.

In the third embodiment, when the primary control loop R1 and the secondary control loop R2 are normally operated and only when the first speed difference $\Delta V_1$ in the primary control loop R1 exceeds the predetermined value, the speed of the transfer belt 10 is controlled according to the combined value $\Delta V$ of the first speed difference $\Delta V_1$ and the second speed difference $\Delta V_2$. The predetermined value is set to a value within the allowable first speed difference $\Delta V_1$ (10% in the example).

The predetermined value mentioned here is a value used to determine whether the combined value $\Delta V$ is to be used for controlling the speed of the transfer belt 10. For example, if the first speed difference $\Delta V_1$ is 10%, any value within 10% can be set as the predetermined value.

The reason that the predetermined value is determined in such a manner is as follows. Assume that the first speed difference $\Delta V_1$ in the primary control loop R1 and the second speed difference $\Delta V_2$ in the secondary control loop R2 are within 10% and therefore the primary control loop R1 and the second control loop R2 are normally operated. However, assume that the first speed difference $\Delta V_1$ is 8% and the second speed difference $\Delta V_2$ is 10% (as a detection position of the speed in the secondary control loop R2 is provided apart from the transfer belt 10, an error increases). In this case, if the speed of the transfer belt 10 is controlled with the combined value $\Delta V$ of the first speed difference $\Delta V_1$ and the second speed difference $\Delta V_2$, then the combined value $\Delta V$ becomes 9% as a result of averaging the first speed difference $\Delta V_1$ and the second speed difference $\Delta V_2$. Therefore, the accuracy of the speed control is degraded as compared with the case where the speed is controlled only by the first speed difference $\Delta V_1$ in the primary control loop R1.

In the third embodiment, only when the first speed difference $\Delta V_1$ in the primary control loop R1 exceeds the predetermined value, the method of correcting the moving speed of the belt 10 is implemented. In other words, only in that case, the speed of the transfer belt 10 is controlled according to the combined value $\Delta V$ of the first speed difference $\Delta V_1$ and the second speed difference $\Delta V_2$. Accordingly, the control is performed according to the combined value $\Delta V$, only when the accuracy of the speed control gets better in the case where the speed of the transfer belt 10 is controlled according to the combined value $\Delta V$ than the case where the speed is controlled only by the first speed difference $\Delta V_1$.

Figure 12:
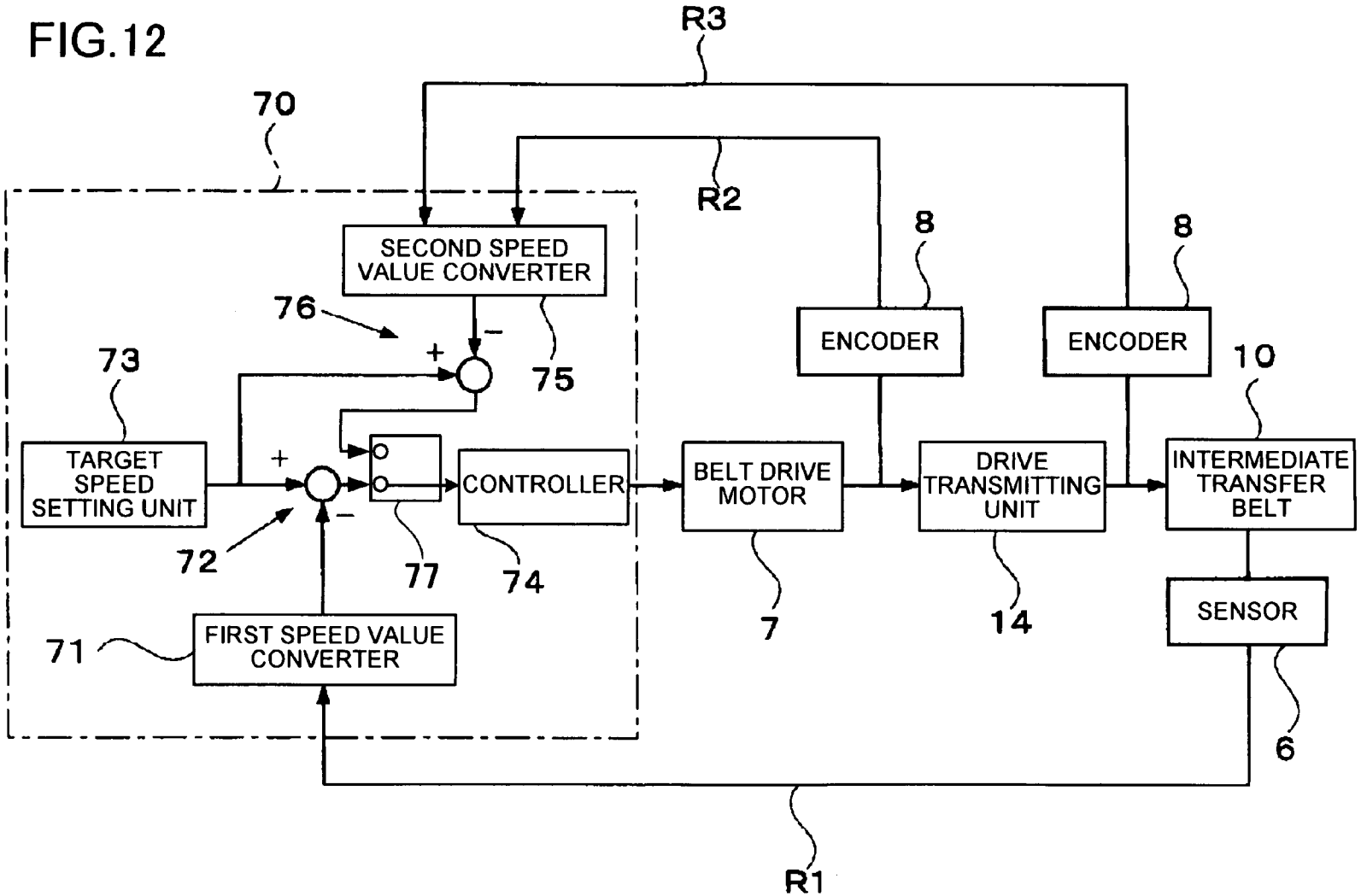
FIG. 12 is a block diagram of control loops of an image forming apparatus according to a fourth embodiment of the present invention.

FIG. 12 is a block diagram of control loops of an image forming apparatus including a transfer apparatus that has two control loops used on occurrence of an abnormality, according to a fourth embodiment of the present invention.

The image forming apparatus of the fourth embodiment is different from that of FIG. 10 only in that another detection portion for the moving speed of the transfer belt 10 is provided at a portion of the belt drive motor 7 in addition to the portion of the driven roller 15. That is, there are provided two control loops used on occurrence of abnormality such as the secondary control loop R2 and the tertiary control loop R3. Therefore, the illustration of the overall image forming apparatus and the explanation thereof are omitted (but FIG. 2 is referred to as required), and only the difference is explained.

Both of the secondary control loop R2 and the tertiary control loop R3 function as control loops that respectively detect an actual speed of the transfer belt 10 and correct the speed of the transfer belt 10 according to the actual speed, respectively.

Furthermore, the secondary control loop R2 and the tertiary control loop R3 are used only when an abnormality occurs in the primary control loop R1. The priority for using them is determined in such a manner that a control loop, having a detection portion for the actual speed of the transfer belt 10 that is the closest to the transfer belt 10, is first selected. The selection of the control loop to be used is controlled by the control device 70 (although the contents of control are different from those of the control device 70 of FIG. 5, the configuration thereof is the same, therefore, the same reference numerals are assigned for simplicity). In the fourth embodiment, the control device 70 functions as a loop selector.

Figure 13:
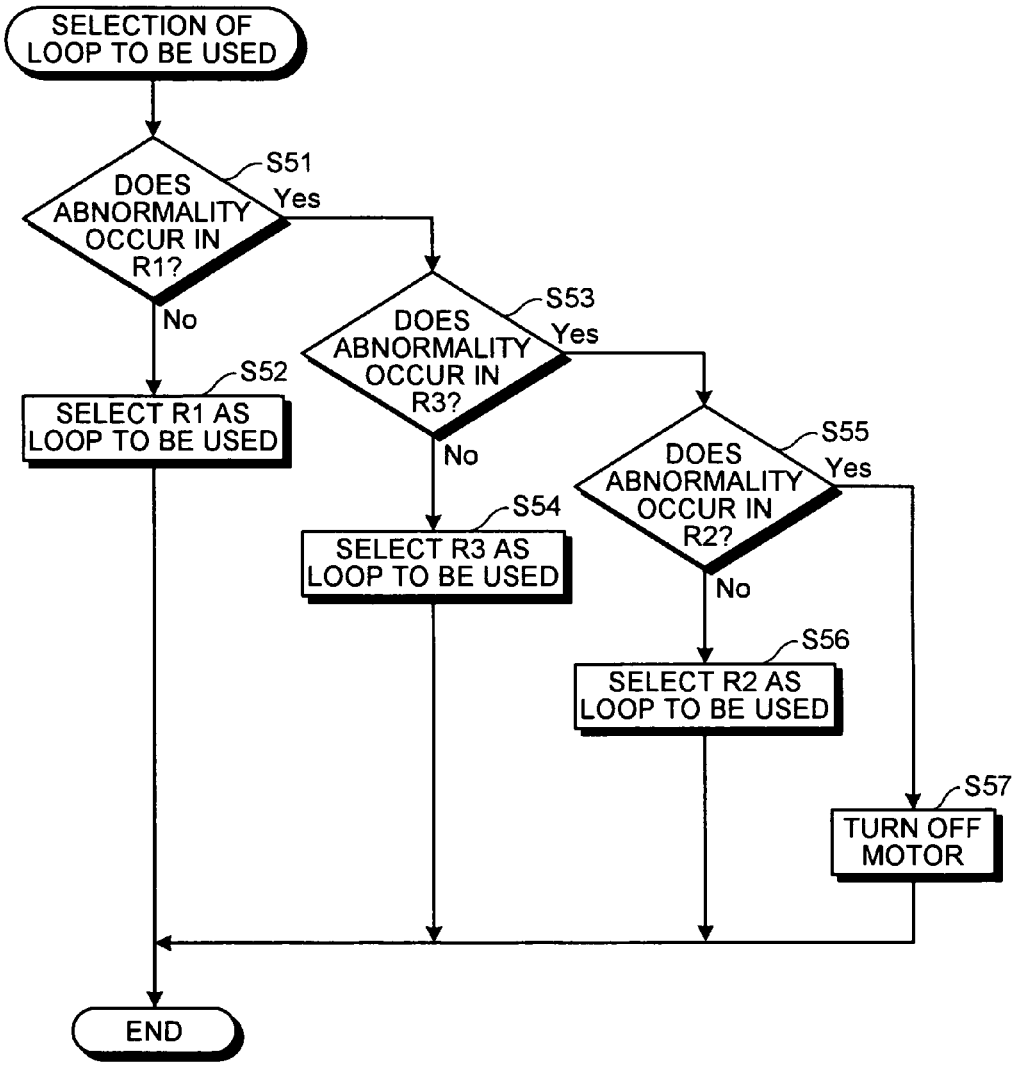
FIG. 13 is a flowchart of a routine of selecting a loop to be used implemented by a microcomputer included in the control device of the fourth embodiment.

FIG. 13 is a flowchart of a routine of selecting a loop to be used implemented by the microcomputer included in the control device 70. The microcomputer starts the routine at a predetermined timing.

At step S51, it is determined whether an abnormality occurs in the primary control loop R1 using the same method as that of the embodiments. If it is determined that no abnormality occurs therein, the process proceeds to step S52 where a control loop to be used is selected as the primary control loop R1, and the routine is ended. If it is determined that an abnormality occurs therein, the process proceeds to step S53. At step S53, it is determined whether an abnormality occurs in the tertiary control loop R3 that detects the speed of the transfer belt 10 from the driven roller 15. As a detection portion of the speed of the transfer belt 10, the driven roller 15 is the second closest, following the primary control loop R1, to the transfer belt 10.

If it is determined that no abnormality occurs in the tertiary control loop R3, the process proceeds to step S54 where a control loop to be used is selected as the tertiary control loop R3, and the routine is ended. If it is determined that an abnormality occurs in the tertiary control loop R3, the process proceeds to step S55. At step S55, it is determined whether an abnormality occurs in the secondary control loop R2 as a control loop having a detection position of the speed that is the farthest from the transfer belt 10.

At step S55, if it is determined that no abnormality occurs in the secondary control loop R2, the process proceeds to step S56 where a control loop to be used is selected as the secondary control loop R2, and the routine is ended. If it is determined that an abnormality occurs in the secondary control loop R2, the process proceeds to step S57 where the belt drive motor 7 for driving the transfer belt 10 is turned off, and the routine is ended.

As explained above, in the fourth embodiment, the method of correcting the moving speed of the belt 10 is implemented in such a manner as follows. The three control loops R1, R2, R3 are selected in order of a control loop having a detection portion of an actual speed of the transfer belt 10 that is the closest to the transfer belt 10. Therefore, the actual speed of the transfer belt 10 can be detected by using the control loop with the highest accuracy at all times. Thus, it is possible to correct the moving speed of the belt 10 with high accuracy.

Figure 14:
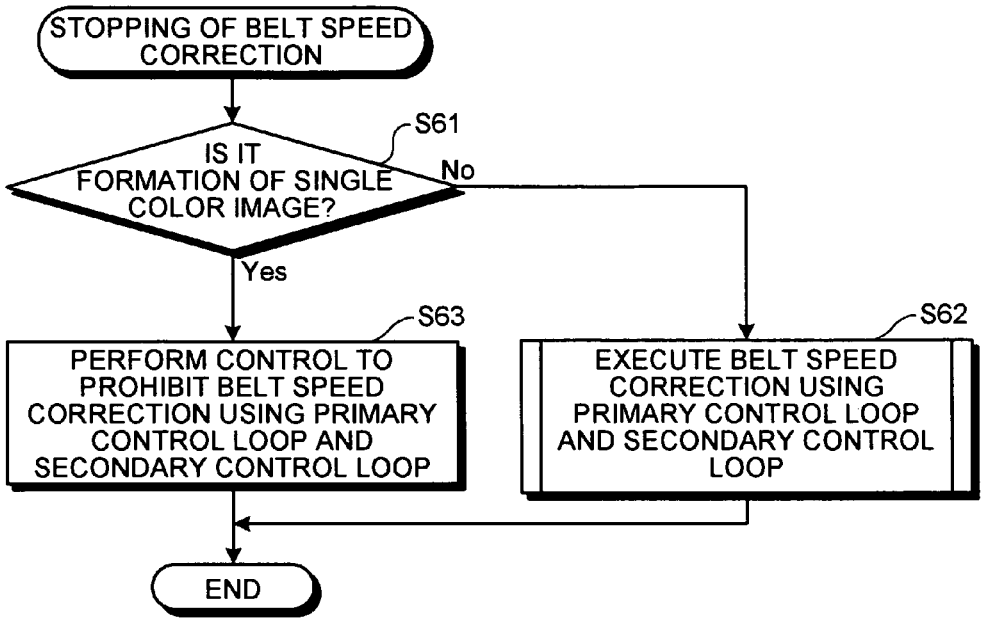
FIG. 14 is a flowchart of the processing of stopping belt speed correction according to a fifth embodiment of the present invention.

FIG. 14 is a flowchart of the processing of stopping correction of a belt speed implemented by a microcomputer included in a control device 70 of an image forming apparatus that includes a transfer apparatus with a belt-speed-correction stopping unit, according to a fifth embodiment of the present invention.

The overall configuration of the image forming apparatus according to the fifth embodiment is the same as that of FIG. 2, and therefore, the illustration thereof is omitted. The configuration of the control device 70 is the same as the control devices 70 in the embodiments of the FIG. 5, FIG. 10, and FIG. 12 although only the contents of control are different, and therefore, the illustration thereof is also omitted.

The microcomputer of the control device 70 according to the fifth embodiment functions also as a belt-speed-correction stopping unit. In a mode of single-color image formation, it is controlled so as to prohibit using both of the primary control loop R1 and the secondary control loop R2 (R3 of FIG. 9 is also the same).

The microcomputer starts the processing of stopping belt speed correction as shown in FIG. 14 at a predetermined timing. At step S61, it is determined whether a mode of formation of only a single color image (including any other color than black) has been selected. If it is determined as No, that is, if a mode of formation of color images has been selected, the process proceeds to step S62 where a subroutine is executed, and the subroutine is ended. The subroutine is the processing of belt speed correction by using the primary control loop R1 and the secondary control loop R2.

Further, at step S61, if the mode of formation of a single color image has been selected, the process proceeds to step S63 where it is controlled so as to prohibit the belt speed correction using the primary control loop R1 and the secondary control loop R2, and the subroutine is ended.

In the fifth embodiment, when the mode of formation of a single color image is selected, the belt speed correction using the primary control loop R1 and the secondary control loop R2 is not executed. Therefore, it is possible to reduce a time required for starting first image formation (first copy) accordingly.

Figure 15:
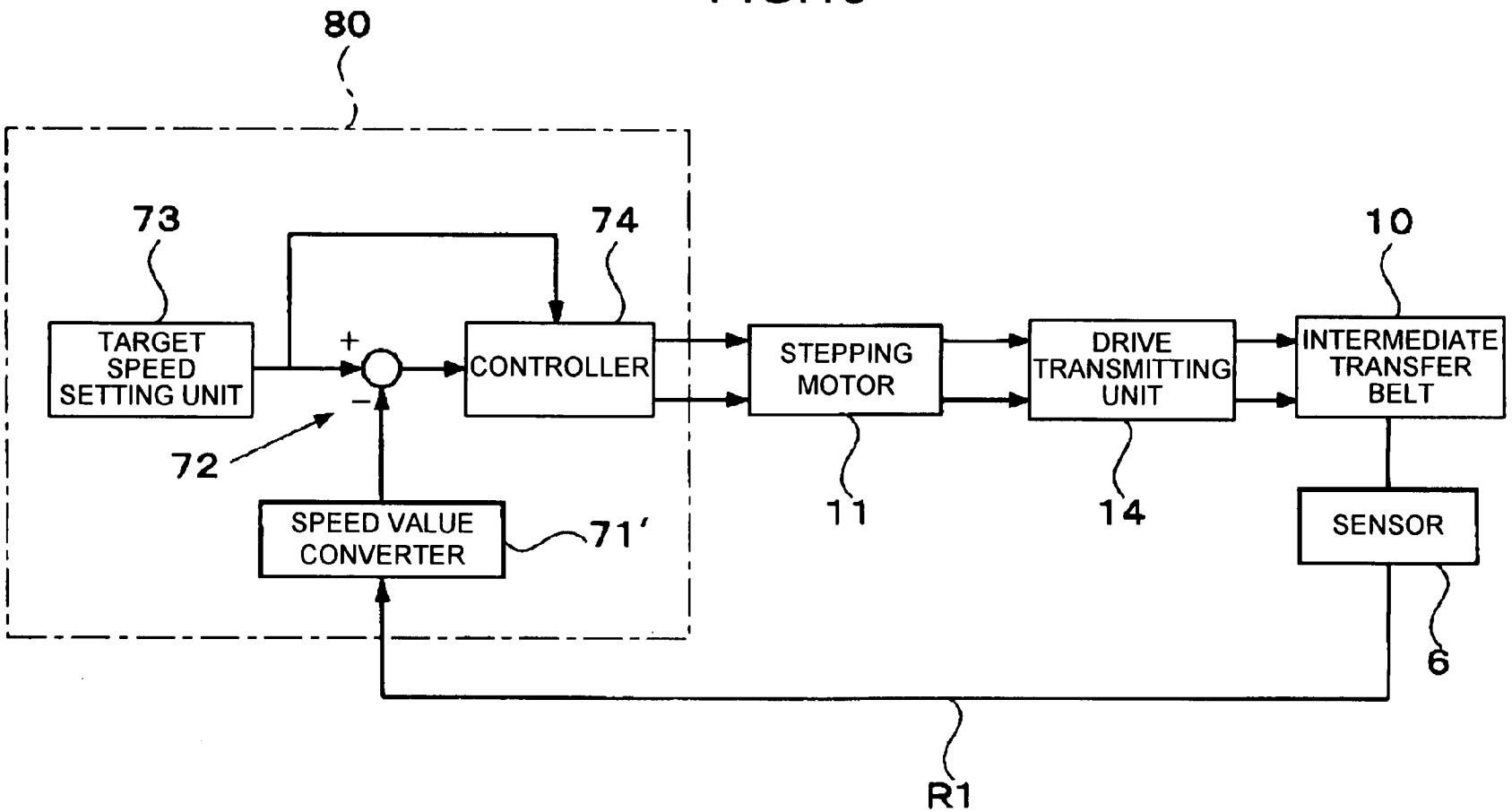
FIG. 15 is a block diagram of a control system according to a sixth embodiment.

FIG. 15 is a block diagram of a control system relating to the control of belt speed correction of an image forming apparatus that includes a transfer apparatus for driving the transfer belt by using a stepping motor, according to a sixth embodiment of the present invention. The same reference numerals are assigned to those corresponding to the components in FIG. 5.

The overall configuration of the image forming apparatus according to the sixth embodiment is also the same as that of FIG. 2, and only the belt drive motor 7 (FIG. 1) is replaced with a stepping motor 11. Therefore, the illustration of the portion related to mechanism is omitted, and explanation is given using the reference numerals assigned to those in FIG. 1 and FIG. 2 as required.

The transfer apparatus of the sixth embodiment includes the transfer belt 10, and the sensor 6 like in the above mentioned embodiments. Specifically, images on the four photosensitive drums are sequentially transferred to the transfer belt 10 so as to be superposed on one another while the transfer belt 10 is rotated. The sensor 6 reads the scale 5 arranged along the whole circumference of the transfer belt 10. The transfer apparatus also includes the primary control loop R1 that detects an actual speed of the transfer belt 10 from information obtained by detecting the scale 5 by the sensor 6, and corrects the speed of the transfer belt 10 according to the actual speed.

Further, in the sixth embodiment, the stepping motor 11 is used for the motor that rotates the transfer belt 10. When an abnormality occurs in the result of detection of the scale 5 by the sensor 6, a control device (control unit) 80 rotates the stepping motor 11 at the target speed to control the speed of the transfer belt 10 without using the primary control loop R1.

The control device 80 includes a microcomputer that has a central processing unit (CPU) having functions of various determinations and processing, a ROM storing processing programs and fixed data, a RAM as data memory that stores processing data, and an I/O circuit.

The motor controller of the control device 80 uses the primary control loop R1 to make the sensor 6 read the scale 5 on the transfer belt 10, and a speed value converter 71' (which is the same as the first speed value converter 71 of FIG. 5) receives a signal of a read value, and outputs the speed value to an arithmetic unit 72. The arithmetic unit 72 also receives a signal corresponding to a target speed from the target speed setting unit 73 that sets the target speed as a basic speed of the transfer belt 10. The arithmetic unit 72 compares an actual speed of the transfer belt 10 input from the speed value converter 71' with the target speed input from the target speed setting unit 73. If there is a difference between the actual speed and the target speed, which is regarded as abnormality, the arithmetic unit 72 does not perform feedback control that requires the primary control loop R1, but controls the controller 74 so as to rotate the stepping motor 11 at the target speed.

As explained above, in the sixth embodiment, the method of correcting the moving speed of the belt is implemented according to the contents of the control. Therefore, even if an abnormality occurs in the primary control loop R1 due to toner contamination on the scale 5, the transfer belt 10 can be made to rotate continuously by rotating the stepping motor 11, capable of being driven in an open loop, at the target speed without performing feedback control, although the control system is provided simply and at low cost.

Figure 16:
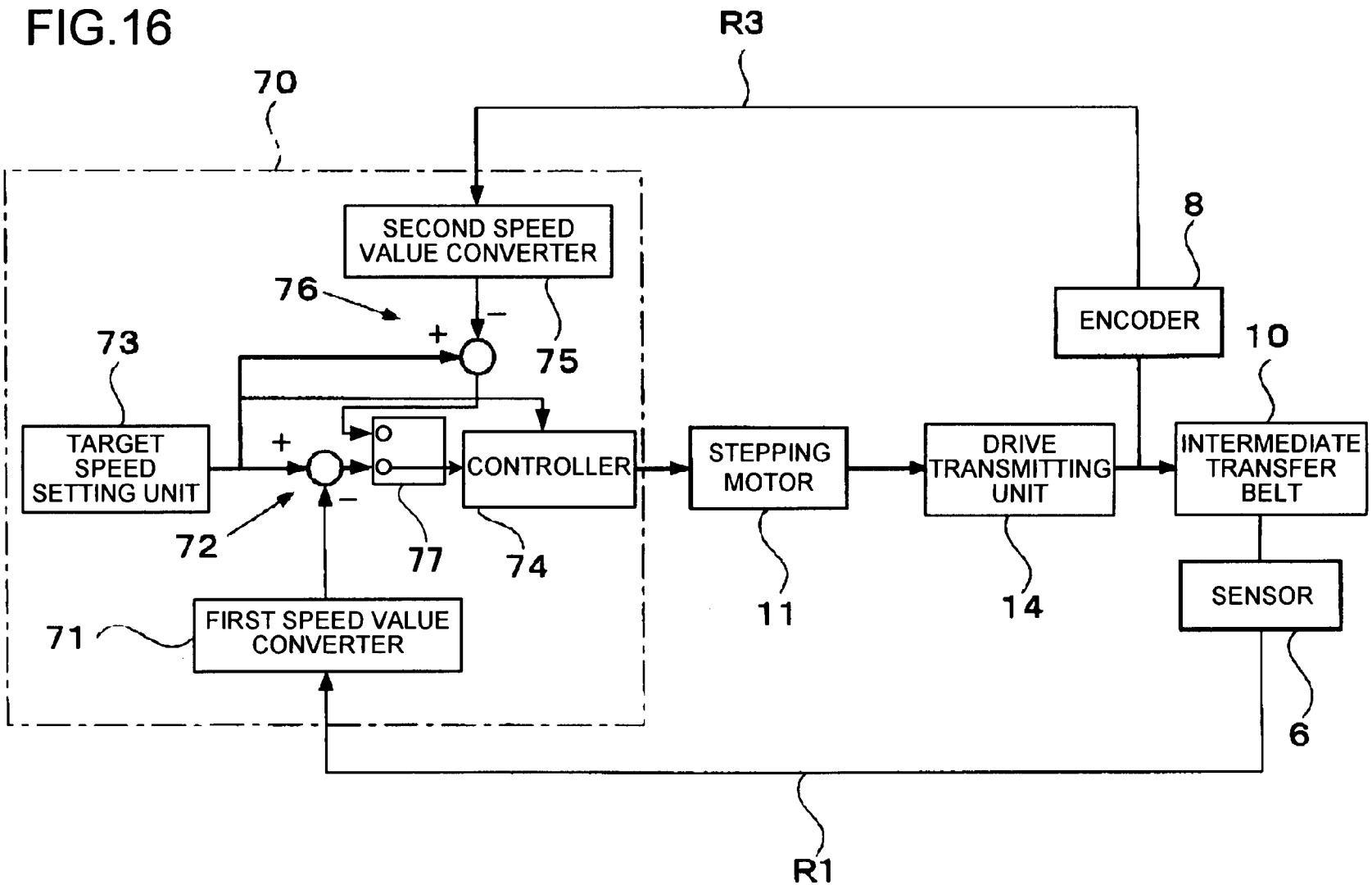
FIG. 16 is a block diagram of a control system according to a seventh embodiment of the present invention.

FIG. 16 is a block diagram of a control system relating to the control of belt speed correction of an image forming apparatus that detects the speed of the transfer belt 10 from the number of revolutions of a driven roller 15 for supporting the transfer belt 10 that is driven by the stepping motor 11, according to a seventh embodiment of the present invention. It is noted that the same reference numerals are assigned to those corresponding to the components in FIG. 15.

The overall configuration of the image forming apparatus is also the same as that of FIG. 2, and only the belt drive motor 7 is replaced with the stepping motor 11. Therefore, the illustration of the portion related to mechanism is omitted.

The seventh embodiment includes the tertiary control loop R3 used when an abnormality occurs in the primary control loop R1, the same as that explained in the third embodiment by referring to FIG. 10. The tertiary control loop R3 includes the encoder 8 as a speed detector that detects the number of revolutions of the driven roller 15 (FIG. 2 or FIG. 9) for rotatably supporting the transfer belt 10. The tertiary control loop R3 corrects the speed of the transfer belt 10 according to the number of revolutions of the driven roller 15 detected by the encoder 8.

The frictional force increasing unit is provided along the circumferential surface of the driven roller 15 to obtain a nonskid surface of the driven roller 15 with respect to the transfer belt 10.

The frictional force increasing unit makes the transfer belt 10 harder to be slippery with respect to the driven roller 15 by forming a number of knurled grooves on the circumferential surface of the driven roller 15, or by uniformly coating a material having characteristics of increasing frictional force over the circumferential surface of the driven roller 15.

In the seventh embodiment, the sensor signal detected by the sensor 6 and the signal output from the encoder 8 are input to the control device 70, and the control device 70 outputs the signal to correct the speed of the transfer belt 10 from the controller 74. However, as the input and output of the signal is the same as that of the case with reference to FIG. 5 and FIG. 10, explanation thereof is omitted.

Figure 17:
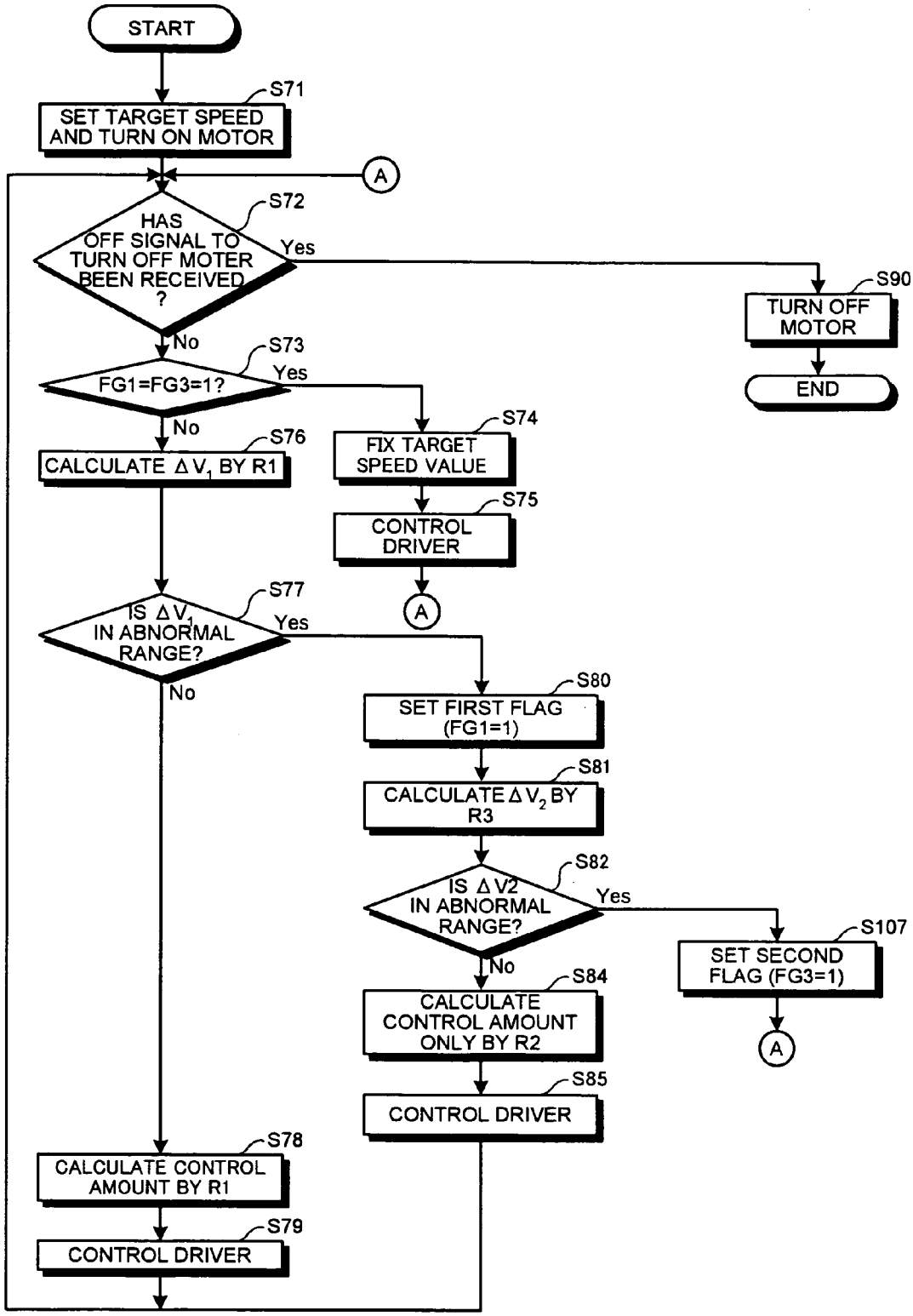
FIG. 17 is a flowchart of a routine of the processing for correcting the moving speed of the belt implemented by a microcomputer included in the control device of the seventh embodiment.

FIG. 17 is a flowchart of a routine of the processing for correcting the moving speed of the belt implemented by a microcomputer included in the control device 70 of FIG. 16.

The microcomputer of the control device 70 starts the routine. At step S71, a target speed V is set for the stepping motor 11, and the stepping motor 11 is turned on. At step S72, it is determined whether an OFF signal to turn off the stepping motor 11 has been received. If the OFF signal has been received, the process proceeds to step S90 where the stepping motor 11 is turned off, and the processing is ended. If the OFF signal has not been received, the process proceeds to step S73 where it is determined whether abnormalities occur in both the primary control loop R1 and the tertiary control loop R3, that is, it is determined whether FG1=FG3=1.

If it is determined that the abnormalities occur therein, i.e., Yes, the process proceeds to step S74 where a target speed value for rotating the stepping motor 11 is fixed. At step S75, the driver is controlled so as to rotate the stepping motor 11 at the fixed target speed value, and the process returns again to step S72.

If it is determined as No at step S73, the process proceeds to step S76 where the actual speed of the transfer belt 10 detected by using the primary control loop R1 is compared with the target speed V to calculate a first speed difference $\Delta V_1$ between the actual speed and the target speed V.

At step S77, it is determined whether the first speed difference $\Delta V_1$ is in an abnormal range or whether the first speed difference $\Delta V_1$ is in an allowable range. If it is beyond the allowable range, the process proceeds to step S80, while if it is within the allowable range, the process proceeds to step S78. At step S78, a control amount to control the stepping motor 11 is calculated so that the speed of the transfer belt 10 having the first speed difference $\Delta V_1$ becomes the target speed V. At step S79, a driver is controlled according to the control amount.

On the other hand, if it is determined at step S77 that the primary control loop R1 is abnormal, the process proceeds to step S80 where the first flag is set (FG1=1), and the process proceeds to step S81. At step S81, only the tertiary control loop R3 is used to detect an actual speed of the transfer belt 10, and the actual speed is compared with the target speed V to calculate a second speed difference $\Delta V_2$ between the actual speed and the target speed.

At step S82, it is determined whether the second speed difference $\Delta V_2$ is in the abnormal range or whether the second speed difference $\Delta V_2$ is in the allowable range. If it is beyond the allowable range (e.g., it exceeds 10% with respect to the target speed), the process proceeds to step S83. At step S83, a third abnormality detected flag (hereinafter, "third flag") indicating that an abnormality occurs in the tertiary control loop R3 is set (FG3=1), and the process returns again to step S72.

At step S82, if the second speed difference $\Delta V_2$ is within the allowable range, the process proceeds to step S84. At step S84, only the tertiary control loop R3 is used to calculate a control amount to control the stepping motor 11 so that the speed of the transfer belt 10 having the second speed difference $\Delta V_2$ becomes the target speed V. At step S85, the driver is controlled according to the control amount. The process then returns to step 72, and the determining and processing operations at step S72 and thereafter are repeated.

If the OFF signal to turn off the stepping motor 11 is received at step S72, the process proceeds from step S72 to step S90, and the processing is ended.

If abnormalities are detected in both the primary control loop R1 and the tertiary control loop R3, the process proceeds to step S77→step S80→step S81→step S82→step S83→step S72→step S73→step S74→step S75, and the speed of the transfer belt 10 is controlled by rotating the stepping motor 11 at the target speed value without stopping the stepping motor 11.

As explained above, in the seventh embodiment, the tertiary control loop R3 is used only when an abnormality occurs in the primary control loop R1. Therefore, when the primary control loop R1 is normally operated, the method of correcting the moving speed of the belt 10 is implemented in such a manner as follows. The speed of the transfer belt 10 is corrected according to only the difference between the actual speed of the transfer belt 10 detected based on the scale 5 and the target speed thereof. During its normal operation, the moving speed of the, transfer belt 10 is directly detected by the sensor 6 in the primary control loop R1. It is thereby possible to obtain a feedback signal with the highest accuracy, thus, correcting the moving speed of the belt with high accuracy.

Figure 18:
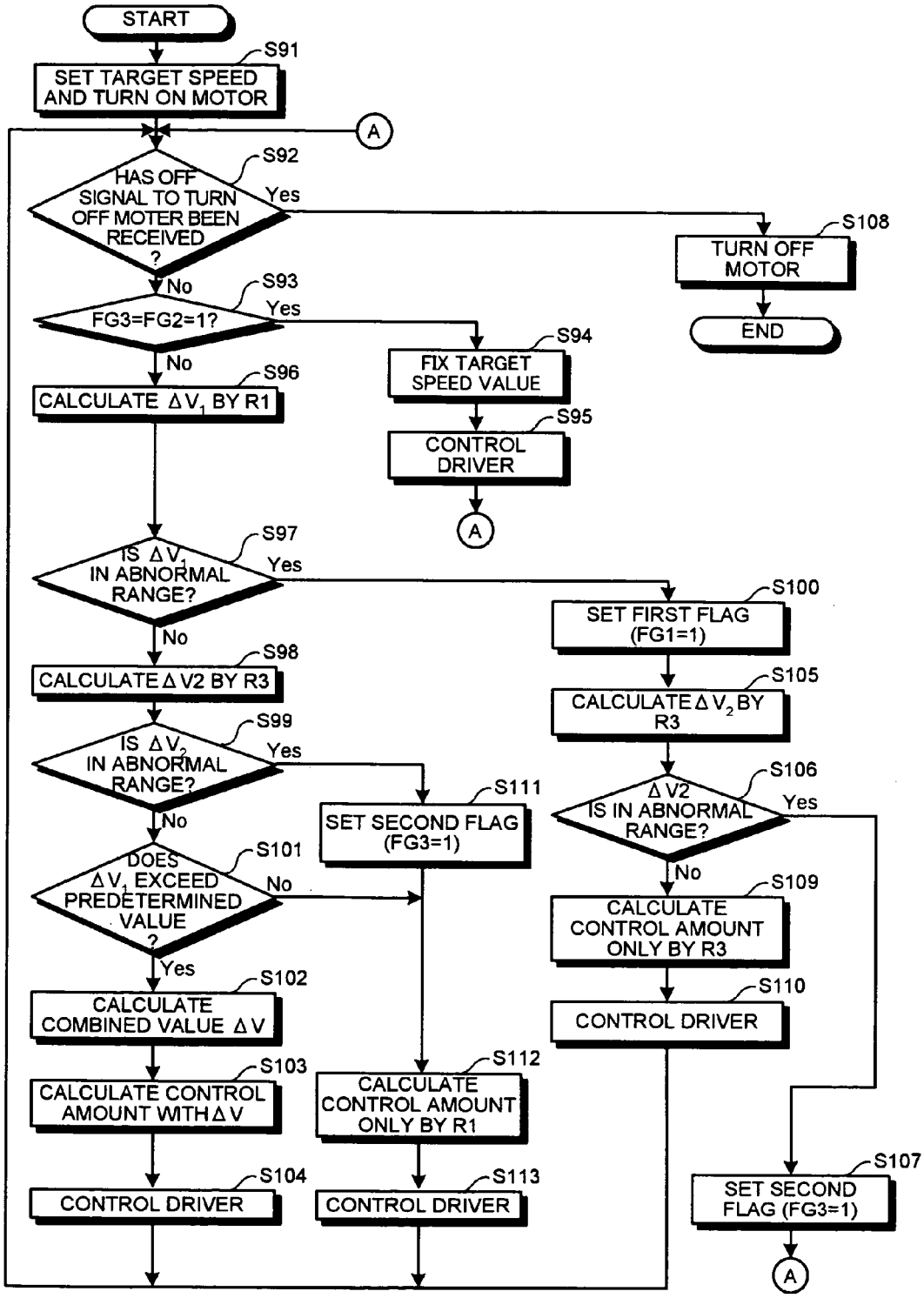
FIG. 18 is a flowchart of operation of an image forming apparatus according to an eighth embodiment of the present invention.

FIG. 18 is a flowchart of an image forming apparatus including a transfer apparatus according to an eighth embodiment of the present invention. The transfer apparatus controls a belt speed by rotation of the stepping motor 11 according to each difference between an actual speed and a target speed of the transfer belt detected respectively by the primary control loop R1 and the tertiary control loop R3.

The components and the control system of the transfer apparatus and the image forming apparatus of the eighth embodiment are the same as those explained with reference to FIG. 1 and FIG. 2. Therefore, the illustration and the explanation thereof are omitted (but FIG. 1, FIG. 2, FIG. 15, and FIG. 16 are referred to as required). Only the processing implemented by the microcomputer of a control device (having the same configuration as that of the control device 70 of FIG. 1) following the method of correcting the moving speed of the belt is explained below.

In the microcomputer of the control device, if both the primary control loop R1 and the tertiary control loop R3 are normally operated but a first speed difference $\Delta V_1$ exceeds a predetermined value (setting is the same as that of FIG. 11), the speed of the transfer belt 10 is corrected according to a combined value ΔV of the first speed difference ΔV1 and a second speed difference ΔV2. More specifically, the first speed difference ΔV1 is obtained between an actual speed of the transfer belt 10 detected based on the scale 5 and a target speed thereof, and the second speed difference $\Delta V_2$ is obtained between an actual speed of the transfer belt 10 detected by the tertiary control loop R3 and the target speed of the transfer belt 10.

In other words, in the eighth embodiment, the control device functions as a control unit that corrects the speed of the transfer belt 10 according to the combined value ΔV.

The microcomputer of the control device starts the routine of the processing for belt speed control as shown in FIG. 18 at a predetermined timing.

At step S91, a target speed V is set for the stepping motor 11, and the stepping motor 11 is turned on. At step S92, it is determined whether an OFF signal to turn off the stepping motor 11 has been received. If the OFF signal has been received, the process proceeds to step S108 where the stepping motor 11 is turned off, and the processing is ended. If the OFF signal has not been received, the process proceeds to step S93 where it is determined whether abnormalities occur in both the primary control loop R1 and the tertiary control loop R3, that is, it is determined whether FG1=FG3=1.

If it is determined that the abnormalities occur therein, i.e., Yes, the process proceeds to step S94 where a target speed value for rotating the stepping motor 11 is fixed. At step S95, the driver is controlled so as to rotate the stepping motor 11 at the fixed target speed value, and the process returns again to step S92.

If it is determined as No at step S93, the process proceeds to step S96 where the actual speed of the transfer belt 10 detected by using the primary control loop R1 is compared with the target speed V to calculate a first speed difference $\Delta V_1$ between the actual speed and the target speed V.

At step S97, it is determined whether the first speed difference $\Delta V_1$ is in an abnormal range or whether the first speed difference $\Delta V_1$ is in an allowable range, for example, within 10% with respect to the target speed. If it is beyond the allowable range, the process proceeds to step 100, while if it is within the allowable range, the process proceeds to step S98. At step S98, the actual speed of the transfer belt 10 detected by using the tertiary control loop R3 is compared with the target speed V to calculate a second speed difference $\Delta V_2$ between the actual speed and the target speed V.

At step S99, it is determined whether the second speed difference $\Delta V_2$ is in the abnormal range or whether the second speed difference $\Delta V_2$ is in the allowable range, for example, within 10% with respect to the target speed. If it is beyond the allowable range, the process proceeds to step S11, while if it is within the allowable range, the process proceeds to step S101.

At step S101, it is determined whether the first speed difference $\Delta V_1$ exceeds a predetermined value (setting is the same as that of FIG. 1) that is set with a value within the allowable range with respect to the target speed. If it is within the predetermined value, the process proceeds to step S112, while if it exceeds the predetermined value, the process proceeds to step S102.

At step S102, a combined value ΔV of the first speed difference $\Delta V_1$ and the second speed difference $\Delta V_2$ is calculated. At step S103, a control amount to control the stepping motor 11 according to the combined value ΔV is calculated so that the speed of the transfer belt 10 having the first speed difference $\Delta V_1$ and the second speed difference $\Delta V_2$ becomes the target speed V. At step S104, a driver is controlled according to the control amount.

On the other hand, if it is determined at step S97 that the first speed difference $\Delta V_1$ is within the abnormal range, the process proceeds to step S100 (when the primary control loop R1 is abnormal) where the first flag is set (FG1=1), and the process proceeds to step S105. At step S105, only the tertiary control loop R3 is used to detect an actual speed of the transfer belt 10, and the actual speed is compared with the target speed V to calculate a second speed difference $\Delta V_2$ between the actual speed and the target speed V.

At step S106, it is determined whether the second speed difference $\Delta V_2$ is in the abnormal range or whether the second speed difference $\Delta V_2$ is in the allowable range (e.g., it is within 10% with respect to the target speed). If it is beyond the allowable range, the process proceeds to step S107. At step S107, the third flag is set (FG3=1), and the process proceeds from step S92 to step S108. At step S108, the stepping motor 11 is turned off, and the processing is ended.

At step S106, if the second speed difference $\Delta V_2$ is within the allowable range, the process proceeds to step S109. At step S109, only the tertiary control loop R3 is used to calculate a control amount to control the stepping motor 11 so that the speed of the transfer belt 10 having the second speed difference $\Delta V_2$ becomes the target speed V. At step S110, the driver is controlled according to the control amount. The process then returns to step S92, and the determining and processing operations at step S92 and thereafter are repeated.

Further, at step S99, if it is determined that the second speed difference $\Delta V_2$ is in the abnormal range, the process proceeds to step S111 where the third flag is set (FG3=1). At step S112, only the primary control loop R1 is used to calculate a control amount to control the stepping motor 11 so that the speed of the transfer belt 10 having the first speed difference $\Delta V_1$ becomes the target speed V. At step S113, the driver is controlled according to the control amount. The process then returns to step S92, and the determining and processing operations at step S92 and thereafter are repeated.

If the OFF signal to turn off the stepping motor 11 is received at step S92, the process proceeds from step S92 to step S108 where the stepping motor 11 is stopped, and the processing is ended.

If abnormalities are detected in both the primary control loop R1 and the tertiary control loop R3, the process proceeds to step S97→step S100→step S105→step S106→step S107→step S92→step S93→step S94→step S95, and the speed of the transfer belt 10 is controlled by rotating the stepping motor 11 at the target speed value without stopping the stepping motor 11.

Therefore, in the eighth embodiment, even if abnormalities occur in both the primary control loop R1 and the tertiary control loop R3, the transfer belt 10 can be driven continuously without being stopped.

Figure 19:
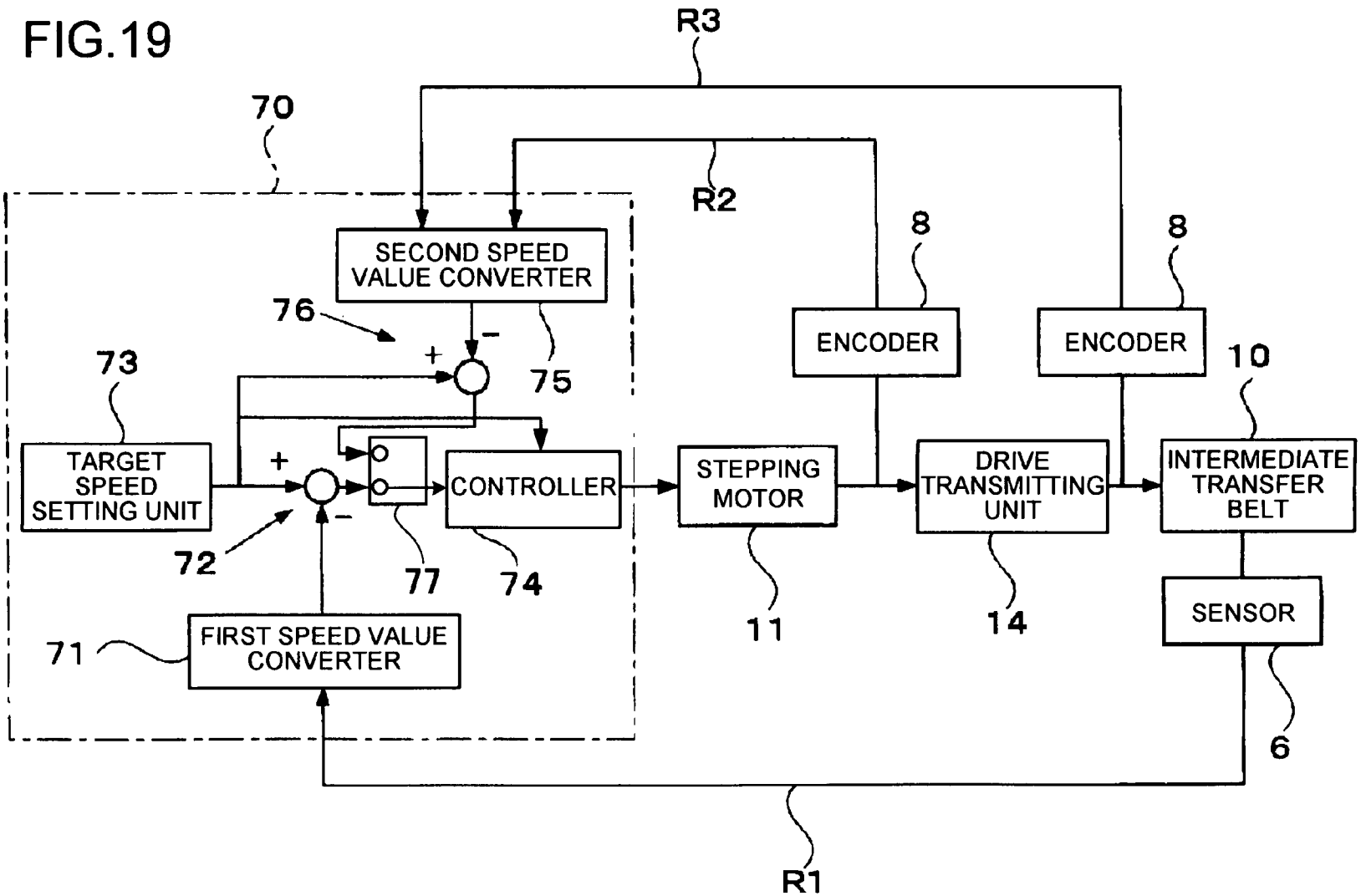
FIG. 19 is a block diagram of control loops of an image forming apparatus according to a ninth embodiment of the present invention.

FIG. 19 is a block diagram of control loops of an image forming apparatus including a transfer apparatus that has two control loops used on occurrence of abnormality, according to a ninth embodiment of the present invention.

The image forming apparatus of the ninth embodiment has only one different point from that of FIG. 16. The different point is such that in addition to the portion of the driven roller 15, the detection portion for the moving speed of the transfer belt 10 is also provided at, for example, a portion of the drive transmitting unit 14 that transmits the torque of the stepping motor 11 to the drive roller 9. That is, there are provided two control loops used on occurrence of abnormality such as the secondary control loop R2 and the tertiary control loop R3 (three or more may be provided). Therefore, the illustration of the overall image forming apparatus and the explanation thereof are omitted, and only the difference is explained.

Both the secondary control loop R2 and the tertiary control loop R3 function as control loops that detect an actual speed of the transfer belt 10 at different detection points and correct the speed of the transfer belt 10 according to the actual speed, respectively.

Furthermore, in the ninth embodiment, both of the secondary control loop R2 and the tertiary control loop R3 are used only when an abnormality occurs in the primary control loop R1. The priority for using them is determined in such a manner that a control loop, having a detection portion for the actual speed of the transfer belt 10 that is the closest to the transfer belt 10, is first selected. The selection of the control loop to be used is controlled by the control device 70 (although the contents of control are different from those of the control device 70 of FIG. 1 and FIG. 16, the configuration thereof is the same, therefore, the same reference numerals are assigned for simplicity). In the ninth embodiment, the control device 70 functions as a loop selector.

When abnormalities occur in all the primary control loop R1 and the secondary and tertiary control loops R2 and R3, the control device 70 functions as a control unit that controls the speed of the transfer belt 10 by rotating the stepping motor 11 at the target speed value.

Figure 20:
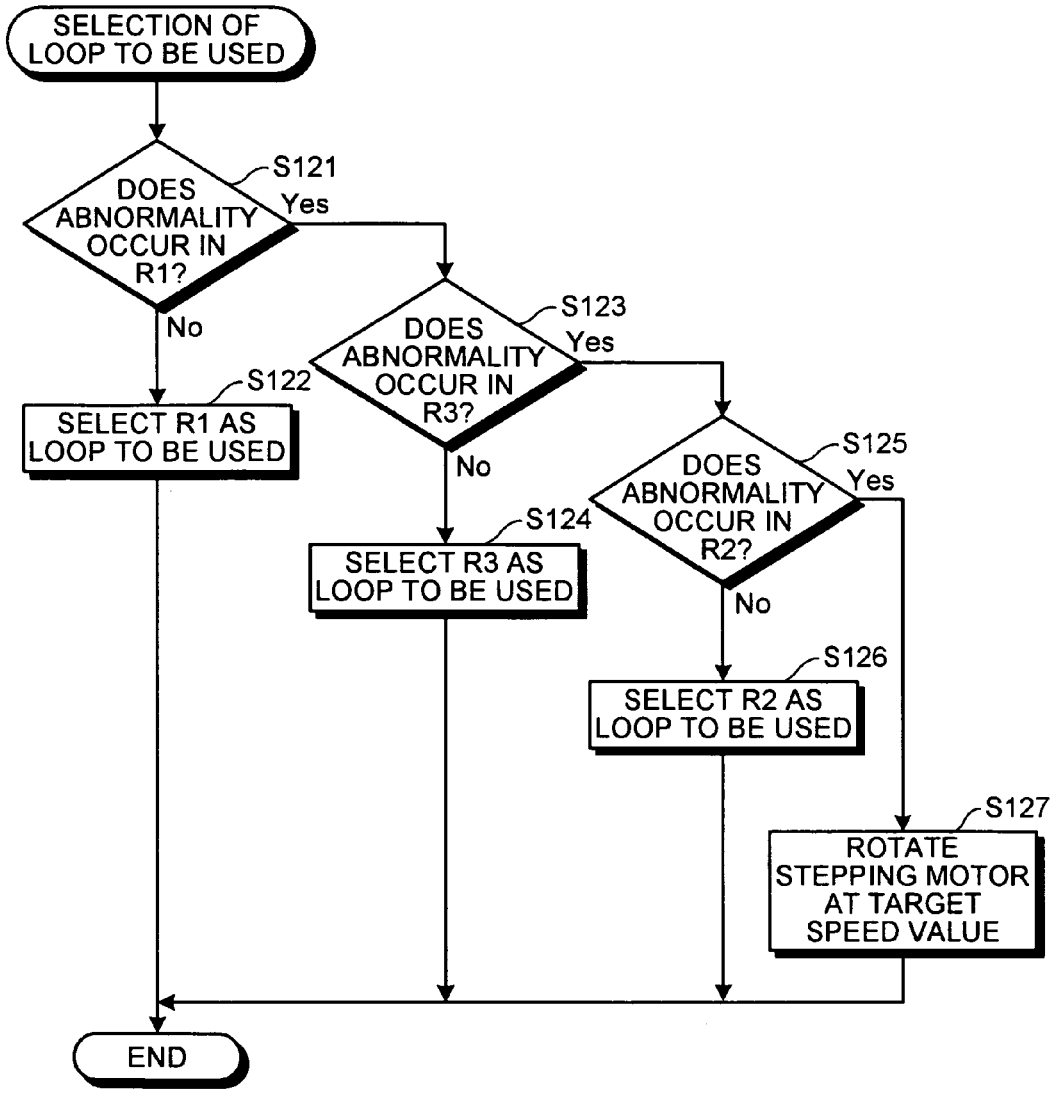
FIG. 20 is a flowchart of a routine of selecting a loop to be used implemented by a microcomputer included in the control device of the transfer apparatus of the ninth embodiment.

FIG. 20 is a flowchart of a routine of selecting a loop to be used implemented by a microcomputer included in the control device 70. The microcomputer starts the routine at a predetermined timing.

At step S121, it is determined whether an abnormality occurs in the primary control loop R1 using the same method as that with reference to FIG. 13. If it is determined that no abnormality occurs therein, the process proceeds to step S122 where a control loop to be used is selected as the primary control loop R1, and the routine is ended. If it is determined that an abnormality occurs therein, the process proceeds to step S123. At step S123, it is determined whether an abnormality occurs in the tertiary control loop R3 that detects the speed of the transfer belt 10 from the driven roller 15. As the detection portion for the speed of the transfer belt 10, the driven roller 15 is the second closest, following the primary control loop R1, to the transfer belt 10.

At step S123, if it is determined that no abnormality occurs in the tertiary control loop R3, the process proceeds to step S124 where a control loop to be used is selected as the tertiary control loop R3, and the routine is ended. If it is determined that an abnormality occurs in the tertiary control loop R3, the process proceeds to step S125. At step S125, it is determined whether an abnormality occurs in the secondary control loop R2 as a control loop having a speed detection position that is the farthest from the transfer belt 10.

At step S125, if it is determined that no abnormality occurs in the secondary control loop R2, the process proceeds to step S126 where a control loop to be used is selected as the secondary control loop R2, and the routine is ended. If it is determined that an abnormality occurs in the secondary control loop R2, the process proceeds to step S127 where the stepping motor 11 is made to rotate at the target speed value, and the routine is ended.

As explained above, in the ninth embodiment, the method of correcting the moving speed of the belt 10 is implemented in such a manner as follows. The three control loops R1, R2, R3 are selected in order of a control loop having a detection portion of an actual speed of the transfer belt 10 that is the closest to the transfer belt 10. Therefore, the actual speed of the transfer belt 10 can be detected by using the control loop with the highest accuracy under the normal situation. Thus, it is possible to correct the moving speed of the belt 10 with high accuracy. Thus, it is possible to correct the moving speed of the belt with high accuracy.

In the embodiments explained with reference to FIG. 16 to FIG. 19, the microcomputer may function also as a belt-speed-correction stopping unit that performs control to prohibit using the primary control loop R1 and the secondary and tertiary control loops R2 and R3 when a single color image is formed.

If the microcomputer performs the processing of stopping belt speed correction explained referring to FIG. 14, there is no need to perform the belt speed correction using the primary control loop 10 and the secondary and the tertiary control loops R2 in the mode of formation of a single color image. Therefore, it is possible to reduce a time required for starting first image formation (first copy) accordingly.

In the embodiments having been explained so far, when the scale 5 on the transfer belt 10 is contaminated with toner or the like to cause abnormality to occur in the primary control loop R1, the secondary control loop R2 or the tertiary control loop R3 is used to perform feedback control on the speed of the transfer belt 10. Further, under the same situation, in the transfer apparatus using the stepping motor 11, the stepping motor 11 is made to rotate at only the target speed value so as to drive continuously the transfer belt 10.

However, the speed control of the belt 10 using the secondary and tertiary control loops R2 and R3 and the control of rotating the stepping motor 11 at only the target speed value are performed as a secondary operation of the primary control loop R1. Therefore, the moving speed of the transfer belt 10 is not directly feedback-controlled, and it is therefore difficult to keep the moving speed of the belt 10 highly accurate.

Figure 21:
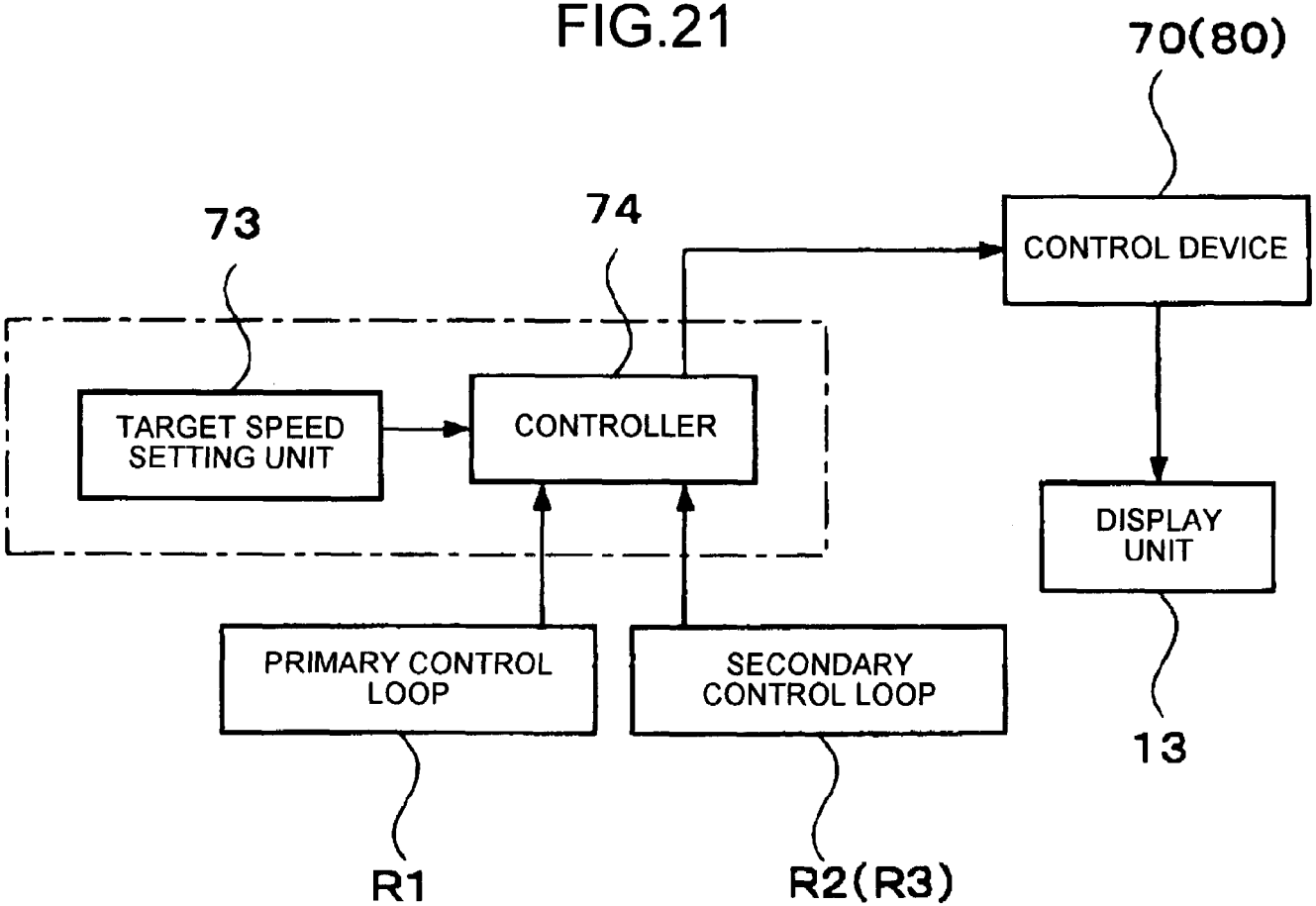
FIG. 21 is a block diagram of an example of the image forming apparatus that causes an external display unit to display notice when an abnormality occurs in the primary control loop.

In the respective image forming apparatuses of the embodiments, the control device 70 (or control device 80)

may also include a function of displaying notice on an externally provided display unit 13, as shown in FIG. 21, on the image forming apparatus (FIG. 2). The display unit 13 displays the notice to notify the operator of occurrence of abnormality in the primary control loop R1.

By providing the function in the control device 70 (or control device 80), if it is determined that an abnormality occurs in the primary control loop R1, the controller 74 of the motor controller determines whether the first flag FG1 is set. If FG1=1, the controller 74 notifies the control device 70 or 80 (main controller) of occurrence of the abnormality in the primary control loop R1 and the notice to that effect is displayed on the display unit 13.

The display contents may include a level of abnormality indicating whether several portions of abnormalities on the scale 5 are detected by the sensor 6, a request to clean the sensor 6, for example, according to frequencies of detecting abnormality, a request to clean the whole of the transfer belt 10, and replacement of the transfer belt 10 with new one if abnormalities occur frequently.

If the control device 70 (or control device 80) has a function as means of displaying occurrence of abnormality in the primary control loop R1, the operator recognizes at once that the abnormality has occurred in the primary control loop R1 from the notice on the display unit 13.

Figure 22:
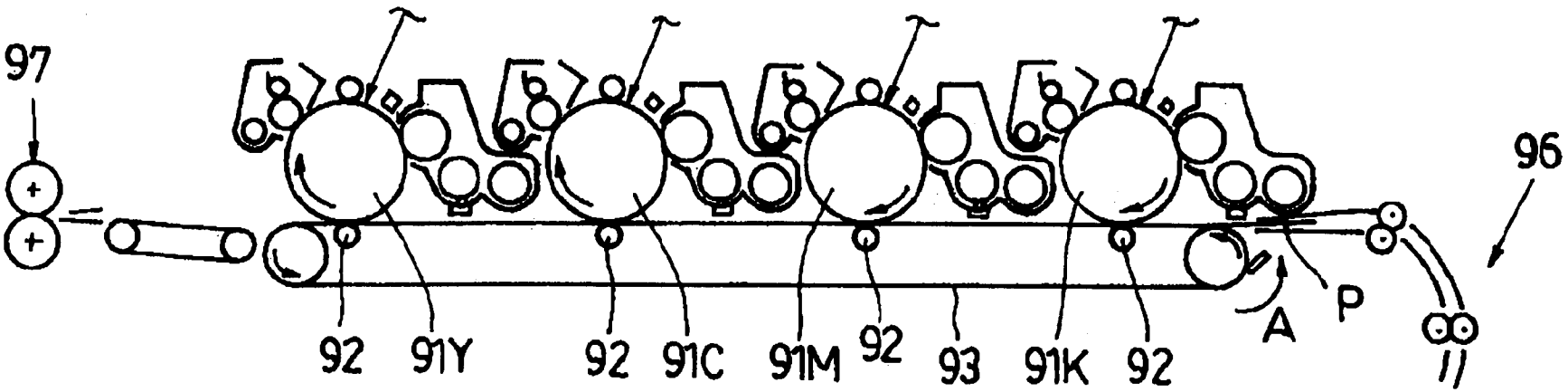
FIG.22 PRIOR ART
FIG. 22 is a diagram of only an imaging unit as an example of the conventional image forming apparatus that uses the direct transfer system.

As explained above, the embodiments of the present invention that is applied to the indirect transfer system of transfer apparatus and image forming apparatus and is also applied to the method of correcting the moving speed of the belt 10 using the indirect transfer system are explained. The present invention is also applicable to the method of correcting the moving speed of the belt 10 in the direct transfer system using the sheet conveying belt as explained with reference to FIG. 22.

In the transfer apparatuses and the image forming apparatuses according to the embodiments, the example of providing the sensor 6 in the vicinity of the driven roller 15 is explained. However, the sensor 2301 may be provided at any other position on the belt 10, for example, a position between the driven roller 16 and the driven roller 15, and the encoder 2302 may be provided to the driven roller 16 as shown in FIG. 23.

Figure 23:
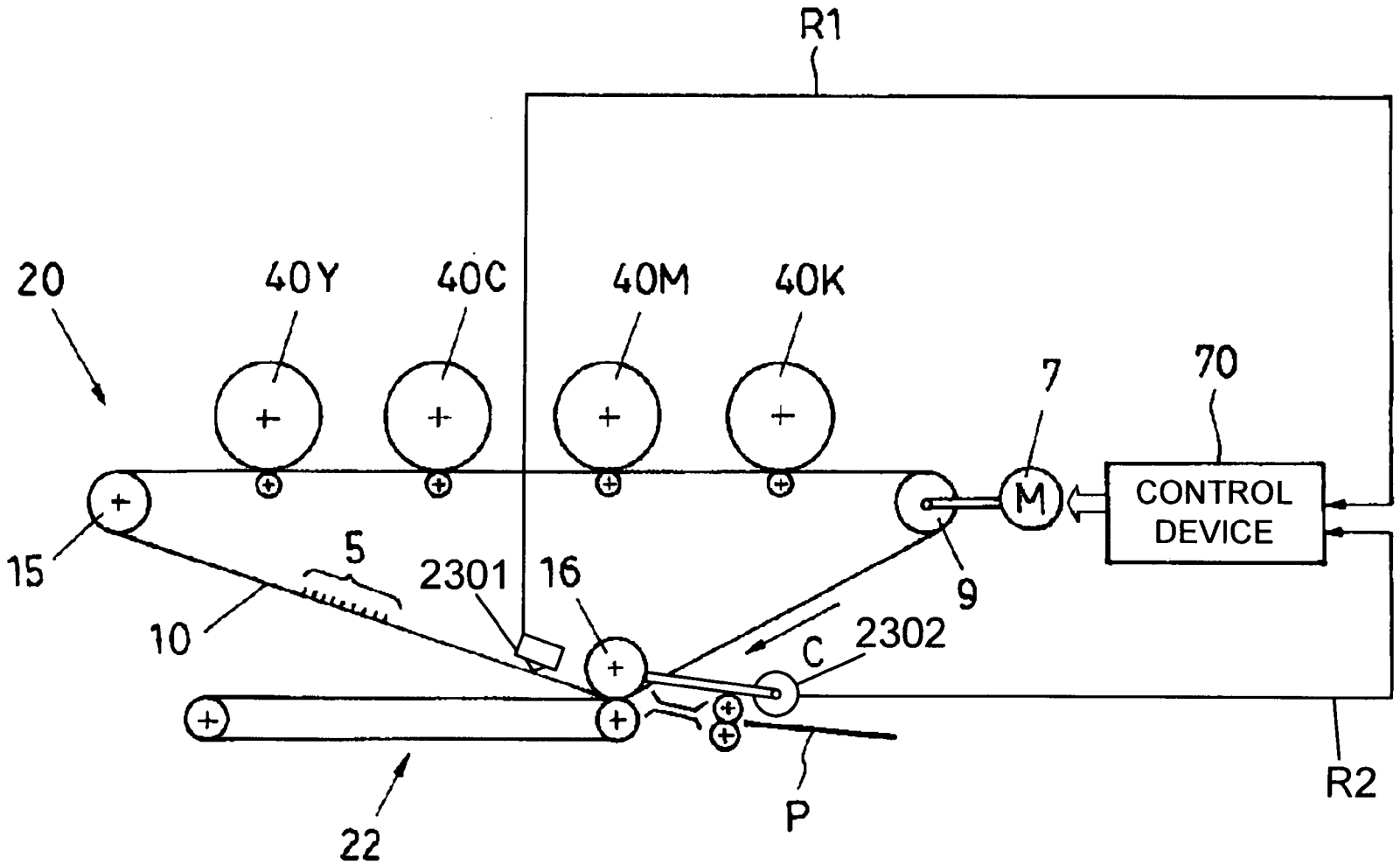
FIG. 23 is a diagram of an image forming apparatus in which a sensor is provided on the belt between the driven rollers, and an encoder is fixed to one of the driven rollers.
Figure 24:
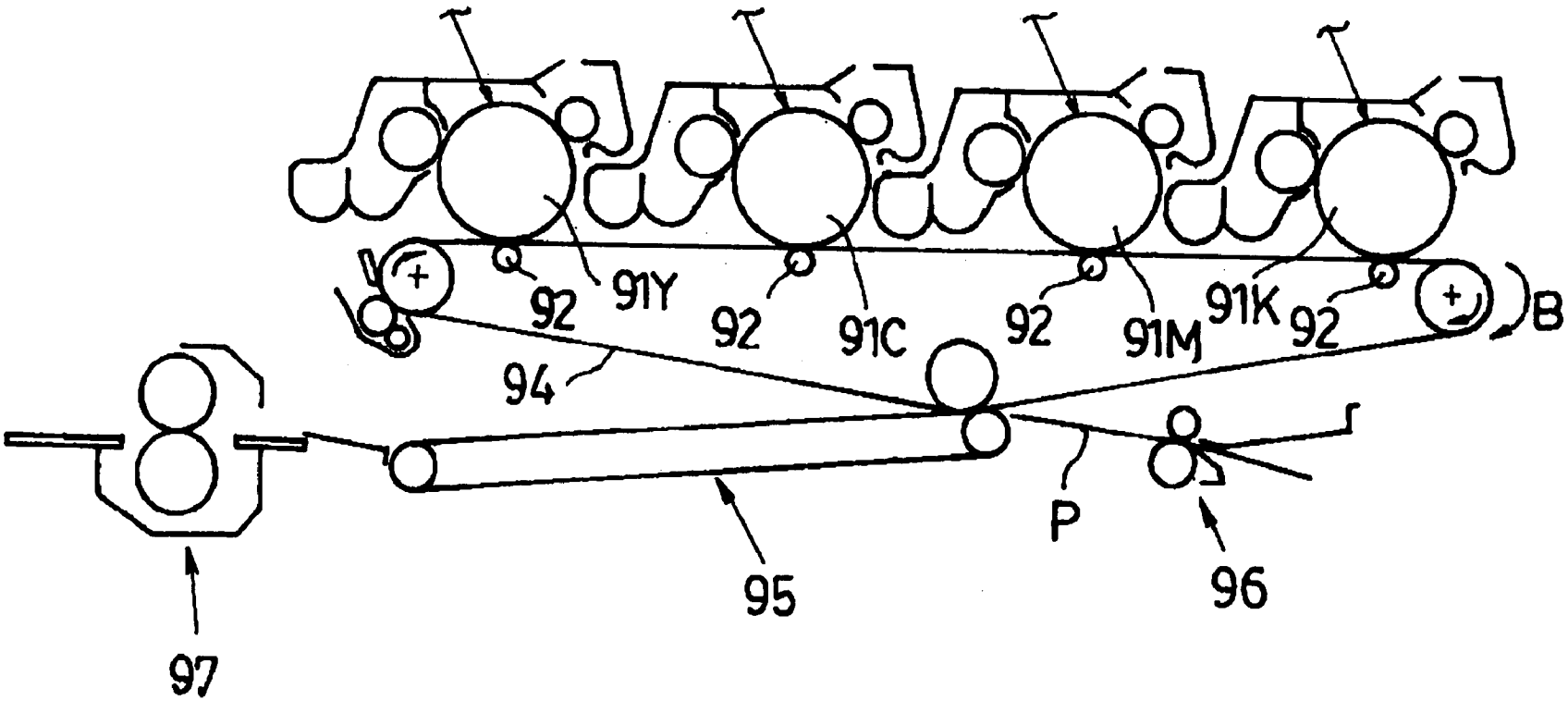
FIG.24 PRIOR ART
FIG. 24 is a diagram of an imaging unit as an example of the conventional image forming apparatus that uses the indirect transfer system.

FIG. 23 is a diagram of an example of an image forming apparatus in which a sensor 2301 is provided at a position on the belt 10 between the driven roller 16 and the driven roller 15 and an encoder 2302 is fixed to the driven roller 16. The speed of the belt 10 is controlled in the same manner as that of the first embodiment.

As explained above, according to one aspect of the present invention, when an abnormality occurs in the primary control loop R1 that detects an actual speed of the transfer belt 10 by reading the scale 5 on the transfer belt 10 by the sensor 6, the secondary control loop R2 that does not use the scale 5 and the sensor 6 is used to correct the speed of the transfer belt 10. Therefore, even if the speed of the transfer belt cannot accurately be detected by the primary control loop R1 due to toner contamination on the scale, or the like, the secondary control loop R2 that does not use the scale 5 and the sensor 6 is used to correct the speed of the transfer belt 10. Thus, even if full color images are directly transferred to the transfer belt 10 or transferred thereto through a recording material so as to be superposed on one another, a high-quality color image free from color misalignment and change in hue is obtained.

According to another aspect of the present invention, when an abnormality occurs in the primary control loop R1, the stepping motor is made to rotate at the target speed value to control the speed of the transfer belt 10. Therefore, although the present invention has a simple and low-cost configuration, it is possible to drive continuously the transfer belt 10 even if an abnormality occurs in the primary control loop E1 due to toner contamination on the scale 5 or the like. Thus, it is possible to make the color misalignment and the change in hue on the transferred image almost unnoticeable.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A transfer apparatus comprising:

a belt that rotates and carries either one of a plurality of images directly and a recording material with a plurality of images, wherein a scale is provided along at least one side of a portion of the belt;

a sensor that reads the scale on the belt to obtain scale information;

an actual speed calculating unit that calculates a speed of the belt from the scale information;

a speed calculating unit that calculates the speed of the belt from information other than the scale information; and a control unit that provides a control to correct the speed of the belt according to the speed calculated.

2. The transfer apparatus according to claim 1, further comprising a motor that rotates the belt, and a speed detector that detects a number of revolutions of the motor, wherein the speed calculating unit calculates the speed of the belt from the number of revolutions of the motor detected by the speed detector.

3. The transfer apparatus according to claim 2, further comprising:

a drive roller that rotatably supports the belt and drives the belt, wherein the torque of the motor is transmitted to the drive roller; and a frictional force increasing unit, provided on a surface of the drive roller, that obtains a nonskid surface of the drive roller with respect to the belt.

4. The transfer apparatus according to claim 2, wherein the speed detector is an encoder.

5. The transfer apparatus according to claim 1, further comprising a driven roller that rotatably supports the belt, and a speed detector that detects a number of revolutions of the driven roller, wherein the speed calculating unit calculates the speed of the belt from the number of revolutions of the driven roller detected by the speed detector.

6. The transfer apparatus according to claim 5, wherein the speed detector is an encoder.

7. The transfer apparatus according to claim 1, further comprising an abnormal operation deciding unit that decides whether the speed of the belt calculated by the actual speed calculating unit is abnormal, and the control unit provides the control to correct the speed of the belt based on the speed calculated by the speed calculating unit when the abnormal operation deciding unit decides that the speed of the belt calculated by the actual speed calculating unit is abnormal.

8. The transfer apparatus according to claim 1, wherein the control unit provides the control to correct the speed of the belt according to a difference between the speed calculated by the actual speed calculating unit and a predetermined target speed.

9. The transfer apparatus according to claim 1, wherein the control unit provides the control to correct the speed of the belt according to a combined value obtained by adding a first speed difference and a second speed difference, wherein the first speed difference is a difference between the speed of the belt calculated by the actual speed calculating unit and a predetermined target speed, and the second speed difference is a difference between the speed of the belt calculated by the speed calculating unit and the target speed.

10. The transfer apparatus according to claim 9, further comprising an abnormal operation deciding unit that decides whether the speed of the belt calculated by unit are abnormal, wherein the control unit corrects the speed of the belt according to the combined value when the abnormal operation deciding unit decides that the speed of the belt calculated by the actual speed calculating unit and the speed of the belt calculated by the speed calculating unit are normal.

11. The transfer apparatus according to claim 10, wherein the control unit provides a control to correct the speed of the belt according to the combined value when the first speed difference exceeds a predetermined value.

12. The transfer apparatus according to claim 9, further comprising an abnormal operation deciding unit that decides whether the speed of the belt calculated by the actual speed calculating unit and the speed of the belt calculated by the speed calculating unit are abnormal, wherein the control unit corrects the speed of the belt according to the combined value when the abnormal operation deciding unit decides that the speed of the belt calculated by the actual speed calculating unit and the speed of the belt calculated by the speed calculating unit are normal.

13. The transfer apparatus according to claim 12, wherein the control unit provides a control to correct the speed of the belt according to the combined value when the first speed difference exceeds a predetermined value.

14. The transfer apparatus according to claim 1, wherein the speed calculating unit includes at least two sub-speed calculating units each of which calculates speed of the belt based on different pieces of information obtained from different detection locations.

15. The transfer apparatus according to claim 14, further comprising an abnormal operation deciding unit that decides whether the speed of the belt calculated by the actual speed calculating unit is abnormal, and the control unit provides the control to correct the speed of the belt according to the speeds of the belt calculated by the sub-speed calculating units when the abnormal operation deciding unit decides that the speed of the belt calculated by the actual speed calculating unit is abnormal.

16. The transfer apparatus according to claim 15, further comprising:

a sub-speed calculating unit selector that selects a sub-speed calculating unit from among the sub-speed calculating units whose speed is to be used by the control unit in controlling the speed of the belt based on a distance between the belt and the detection location of each of the sub-speed calculating unit.

17. The transfer apparatus according to claim 16, further comprising:

a sub-speed calculating unit selector that selects a sub-speed calculating unit from among the sub-speed calculating units whose speed is to be used by the control unit in controlling the speed of the belt based on a distance between an intermediate transfer belt as the belt and the detection location of each of the sub-speed calculating unit.

18. The transfer apparatus according to claim 1, further comprising:

a belt-speed-control stopping unit that inhibits control to correct the speed of the belt by the control unit when a single color image is formed.

19. A transfer apparatus comprising:

a belt that rotates by torque from a motor as a stepping motor and carries either one of a plurality of images directly and a recording material with a plurality of images, wherein a scale is provided along at least one side of the entire belt;

a sensor that reads the scale on the belt to obtain scale information;

an actual speed calculating unit that calculates a speed of the belt from the scale information;

an abnormality detection unit that decides whether the speed of the belt detected by the actual speed calculating unit is abnormal;

a control unit that provides a control to correct speed of the belt according to the speed calculated; and a motor control unit that, when the abnormality detection unit decides that the speed of the belt detected by the actual speed calculating unit is abnormal, invalidates correction of the speed of the belt by the control unit and controls the stepping motor to rotate at a predetermined target speed.

20. The transfer apparatus according to claim 19, further comprising an abnormal operation deciding unit that decides whether the speed of the belt calculated by the actual speed calculating unit is abnormal, wherein the control unit provides the control to correct the speed of the belt according to a difference between the speed of the belt calculated by the actual speed calculating unit and a predetermined target speed when the abnormal operation deciding unit decides that the speed of the belt calculated by the actual speed calculating unit is abnormal.

21. The transfer apparatus according to claim 19, further comprising a speed calculating unit that calculates a speed of the belt from information other than the scale information.

22. The transfer apparatus according to claim 21, further comprising an abnormal operation deciding unit that decides whether the speed of the belt calculated by the actual speed calculating unit is abnormal, and the control unit provides the control to correct the speed of the belt based on the speed calculated by the speed calculating unit when the abnormal operation deciding unit decides that the speed of the belt calculated by the actual speed calculating unit is abnormal.

23. The transfer apparatus according to claim 21, wherein the control unit provides the control to correct the speed of the belt according to a combined value obtained by adding a first speed difference and a second speed difference, wherein the first speed difference is a difference between the speed of the belt calculated by the actual speed calculating unit and a predetermined target speed, and the second speed difference is a difference between the speed of the belt calculated by the speed calculating unit and the target speed.

24. The transfer apparatus according to claim 21, wherein the speed calculating unit includes at least two sub-speed calculating units each of which calculates speed of the belt based on different pieces of information obtained from different detection locations.

25. The transfer apparatus according to claim 24, further comprising an abnormal operation deciding unit that decides whether the speed of the belt calculated by the actual speed calculating unit is abnormal, wherein the control unit provides the control to correct the speed of the belt according to the speeds of the belt calculated by the sub-speed calculating units when the abnormal operation deciding unit decides that the speed of the belt calculated by the actual speed calculating unit is abnormal.

26. The transfer apparatus according to claim 25, further comprising:

a sub-speed calculating unit selector that selects a sub-speed calculating unit from among the sub-speed calculating units whose speed is to be used by the control unit in controlling the speed of rotation of the belt based on a distance between the belt and the detection location of each of the sub-speed calculating unit.

27. The transfer apparatus according to claim 26, further comprising:

a sub-speed calculating unit selector that selects a sub-speed calculating unit from among the sub-speed calculating units whose speed is to be used by the control unit in controlling the speed of the belt based on a distance between an intermediate transfer belt as the belt and the detection location of each of the sub-speed calculating unit.

28. The transfer apparatus according to claim 21, further comprising a driven roller that rotatably supports the belt, and a speed detector that detects a number of revolutions of the driven roller, wherein the speed calculating unit calculates the speed of the belt from the number of revolutions of the driven roller detected by the speed detector.

29. The transfer apparatus according to claim 28, further comprising a frictional force increasing unit, provided on a surface of the driven roller, that obtains a nonskid surface of the driven roller with respect to the belt.

30. The transfer apparatus according to claim 28, wherein the speed detector is an encoder.

31. The transfer apparatus according to claim 28, further comprising an abnormal operation deciding unit that decides whether the speed of the belt calculated by the actual speed calculating unit and the speed of the belt calculated by the speed calculating unit are abnormal, wherein the motor control unit provides a control to rotate the stepping motor at a predetermined target speed when the abnormal operation deciding unit decides that the speed of the belt calculated by the actual speed calculating unit and the speed of the belt calculated by the speed calculating unit are abnormal.

32. The transfer apparatus according to claim 28, further comprising:

a belt-speed-control stopping unit that inhibits control to correct the speed of the belt by the control unit when a single color image is formed.

33. An image forming apparatus comprising a transfer apparatus, the transfer apparatus including a belt that rotates and carries either one of a plurality of images directly and a recording material with a plurality of images, a scale is provided along at least one side of a portion of the belt;

a sensor that reads the scale on the belt to obtain scale information;

an actual speed calculating unit that calculates a speed of the belt from the scale information;

a speed calculating unit that calculates a speed of the belt from information other than the scale information; and a control unit that provides a control to correct speed of the belt according to the speed calculated.

34. The image forming apparatus according to claim 33, further comprising an abnormality occurrence display unit that causes an external display unit to display notice indicating that the speed of the belt calculated by the actual speed calculating unit is abnormal when the speed of the belt calculated by the actual speed calculating unit is abnormal.

35. An image forming apparatus comprising a transfer apparatus, the transfer apparatus including a belt that rotates by torque from a motor as a stepping motor and carries either one of a plurality of images directly and a recording material with a plurality of images, a scale is provided along at least one side of the entire belt;

a sensor that reads the scale on the belt to obtain scale information;

an actual speed calculating unit that calculates a speed of the belt from the scale information;

an abnormality detection unit that decides whether the speed of the belt detected by the actual speed calculating unit is abnormal;

a control unit that provides a control to correct speed of the belt according to the speed calculated; and a motor control unit that, when the abnormality detection unit decides that the speed of the belt detected by the actual speed calculating unit is abnormal, invalidates correction of the speed of the belt by the control unit and controls the stepping motor to rotate at a predetermined target speed.

36. The image forming apparatus according to claim 35, further comprising an abnormality occurrence display unit that causes an external display unit to display notice indicating that the speed of the belt calculated by the actual speed calculating unit is abnormal when the abnormality detection unit decides that the speed of the belt detected by the actual speed calculating unit is abnormal.

37. A method of correcting a speed of a belt, comprising:

reading a scale on the belt to obtain scale information, the belt being rotatable and carries either one of a plurality of images directly and a recording material with a plurality of images, wherein a scale is provided along at least one side of a portion of the belt;

calculating a speed of the belt from the scale information;

calculating a speed of the belt from information other than the scale information;

controlling the speed of the belt according to the speed calculated.

38. The method according to claim 37, further comprising deciding whether the speed calculated from the scale information is normal, wherein the step of controlling includes controlling the speed of the belt according to a difference between the speed calculated from the scale information and a predetermined target speed when it is decided at the deciding step that the speed calculated from the scale information is normal.

39. The method according to claim 37, wherein the step of controlling includes controlling the speed of the belt according to a combined value of a first speed difference and a second speed difference when the speed of the belt calculated from the scale information and the speed of the belt calculated from information other than the scale information are normal but the first speed difference exceeds a predetermined value, wherein the first speed difference is a difference between the speed of the belt calculated from the scale information and a predetermined target speed, and the second speed difference is a difference between the speed of the belt calculated from information other than the scale information.

40. The method according to claim 37, wherein the step of calculating the speed of the belt from information other than the scale information includes calculating speeds of the belt based on at least two different pieces of information obtained from different detection locations; and deciding a speed of the belt, from among the speeds of the belt calculated based from at least two different pieces of information, that corresponds to a detection location that is closest to the belt as the speed of the belt that is to be used at the controlling step.

41. A method of correcting a speed of a belt, comprising:

reading a scale on the belt to obtain scale information, the belt being rotated by a stepping motor and carries either one of a plurality of images directly and a recording material with a plurality of images, a scale is provided along at least one side of the entire belt;

calculating a speed of the belt from the scale information;

deciding whether the speed of the belt calculated from the scale information is abnormal; and controlling the speed of the belt based on the speed of the belt calculated from the scale information when it is decided at the deciding step that the speed of the belt calculated from the scale information is normal, and controlling a speed of rotation of the stepping motor so as to be substantially the same as a predetermined target speed when it is decided step at the deciding that the speed of the belt calculated from the scale information is abnormal.

42. A method of correcting a speed of a belt, comprising:

reading a scale on the belt to obtain scale information, the belt being rotated by a stepping motor and carries either one of a plurality of images directly and a recording material with a plurality of images, a scale is provided along at least one side of the entire belt;

calculating a speed of the belt from the scale information;

calculating a speed of the belt from information other than the scale information;

deciding whether the speed of the belt calculated from the scale information and the speed of the belt calculated from the information other than the scale information are abnormal; and controlling the speed of the belt based on the speed of the belt calculated from the scale information when it is decided at the deciding step that the speed of the belt calculated from the scale information is normal, controlling the speed of the belt based on the speed of the belt calculated from the information other than the scale information when it is decided at the deciding step that the speed of the belt calculated from the scale information is abnormal, and controlling a speed of the stepping motor so as to be substantially the same as a predetermined target speed when it is decided at the deciding step that the speed of the belt calculated from the scale information and the speed of the belt calculated from the information other than the scale information are abnormal.

* * * * *